US010732529B2

(12) United States Patent
Yoshiba et al.

(10) Patent No.: US 10,732,529 B2
(45) Date of Patent: Aug. 4, 2020

(54) POSITIVE-CHARGING TONER

(71) Applicant: CANON KABUSHIKI KAISHA, Tokyo (JP)

(72) Inventors: Daisuke Yoshiba, Suntou-gun (JP); Tomoya Nagaoka, Tokyo (JP); Takashi Matsui, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/438,605

(22) Filed: Jun. 12, 2019

(65) Prior Publication Data

US 2019/0384194 A1 Dec. 19, 2019

(30) Foreign Application Priority Data

Jun. 13, 2018 (JP) ..... 2018-113075
Apr. 10, 2019 (JP) ..... 2019-075025

(51) Int. Cl.
*G03G 9/087* (2006.01)
*G03G 9/097* (2006.01)
*G03G 9/08* (2006.01)

(52) U.S. Cl.
CPC ..... *G03G 9/08711* (2013.01); *G03G 9/0823* (2013.01); *G03G 9/08708* (2013.01);
(Continued)

(58) Field of Classification Search
CPC ..... G03G 9/08711; G03G 9/09708; G03G 9/0823; G03G 9/09775; G03G 9/08791;
(Continued)

(56) References Cited

U.S. PATENT DOCUMENTS 7,537,877 B2 5/2009 Yoshiba et al.
7,544,455 B2 6/2009 Yoshiba et al.
(Continued)

FOREIGN PATENT DOCUMENTS

EP 0 703 505 3/1996
EP 0 744 668 11/1996
(Continued)

OTHER PUBLICATIONS

U.S. Appl. No. 16/438,537, Kentaro Kamae, filed Jun. 12, 2019.
(Continued)

*Primary Examiner* — Thorl Chea
(74) *Attorney, Agent, or Firm* — Venable LLP

(57) ABSTRACT

Provided is a positive-charging toner having a toner particle that contains a binder resin, the binder resin contains a polymer A having a first monomer unit derived from a first polymerizable monomer, and a second monomer unit derived from a second polymerizable monomer, the first polymerizable monomer is at least one selected from the group consisting of (meth)acrylic acid esters having a C18 to C36 alkyl group, the content of the first monomer unit in the polymer A is 5.0 to 60.0 mol % and the content of the second monomer unit is 20.0 to 95.0 mol %, $SP_{11}$ of the first monomer unit and $SP_{21}$ of the second monomer unit satisfy $3.00 \leq (SP_{21} - SP_{11}) \leq 25.00$, and the work function of the toner is 5.0 to 5.4 V.

12 Claims, 2 Drawing Sheets

(52) U.S. Cl.
CPC ..... *G03G 9/08724* (2013.01); *G03G 9/08731* (2013.01); *G03G 9/08791* (2013.01); *G03G 9/09708* (2013.01)

(58) Field of Classification Search
CPC ..... G03G 9/08795; G03G 9/09741; G03G 9/08722; G03G 9/08724; G03G 9/08728; G03G 9/08731; G03G 9/08733; G03G 9/08713; G03G 9/08708
See application file for complete search history.

(56) References Cited

U.S. PATENT DOCUMENTS

| | | | |
|---|---|---|---|
| 7,678,523 | B2 | 3/2010 | Hiroko et al. |
| 7,700,254 | B2 | 4/2010 | Moribe et al. |
| 7,740,998 | B2 | 6/2010 | Yamazaki et al. |
| 7,796,926 | B2 | 9/2010 | Matsuda et al. |
| 7,842,446 | B2 | 11/2010 | Yanase et al. |
| 7,885,042 | B2 | 2/2011 | Shimazawa et al. |
| 7,923,190 | B2 | 4/2011 | Magome et al. |
| 7,935,467 | B2 | 5/2011 | Dojo et al. |
| 8,057,977 | B2 | 11/2011 | Moribe et al. |
| 8,426,091 | B2 | 4/2013 | Magome et al. |
| 8,426,094 | B2 | 4/2013 | Magome et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,883,389 | B2 | 11/2014 | Matsui et al. |
| 9,097,997 | B2 | 8/2015 | Nomura et al. |
| 9,097,998 | B2 | 8/2015 | Yamazaki et al. |
| 9,128,400 | B2 | 9/2015 | Takahashi et al. |
| 9,201,323 | B2 | 12/2015 | Nishikawa et al. |
| 9,213,250 | B2 | 12/2015 | Nomura et al. |
| 9,217,943 | B2 | 12/2015 | Matsui et al. |
| 9,239,528 | B2 | 1/2016 | Hasegawa et al. |
| 9,250,548 | B2 | 2/2016 | Nomura et al. |
| 9,261,804 | B2 | 2/2016 | Yamazaki et al. |
| 9,304,422 | B2 | 4/2016 | Matsui et al. |
| 9,341,970 | B2 | 5/2016 | Yoshiba et al. |
| 9,348,246 | B2 | 5/2016 | Magome et al. |
| 9,354,545 | B2 | 5/2016 | Matsui et al. |
| 9,442,416 | B2 | 9/2016 | Magome et al. |
| 9,442,419 | B2 | 9/2016 | Wakabayashi et al. |
| 9,581,934 | B2 | 2/2017 | Ito et al. |
| 9,606,462 | B2 | 3/2017 | Nomura et al. |
| 9,658,546 | B2 | 5/2017 | Tanaka et al. |
| 9,829,818 | B2 | 11/2017 | Yoshiba et al. |
| 9,857,707 | B2 | 1/2018 | Tsuda et al. |
| 9,904,195 | B2 | 2/2018 | Matsui et al. |
| 9,971,263 | B2 | 5/2018 | Fukudome et al. |
| 10,012,919 | B2 | 7/2018 | Matsui et al. |
| 10,101,683 | B2 | 10/2018 | Nishikawa et al. |
| 10,156,800 | B2 | 12/2018 | Tsuda et al. |
| 10,197,934 | B2 | 2/2019 | Matsui et al. |
| 10,241,430 | B2 | 3/2019 | Kimura et al. |
| 10,289,016 | B2 | 5/2019 | Fukudome et al. |
| 10,295,921 | B2 | 5/2019 | Ohmori et al. |
| 2004/0137349 | A1* | 7/2004 | Horikoshi ..... G03G 9/09 430/108.6 |
| 2004/0185367 | A1 | 9/2004 | Serizawa et al. |
| 2007/0166636 | A1* | 7/2007 | Daimon ..... G03G 9/0825 430/109.3 |
| 2009/0087768 | A1 | 4/2009 | Tosaka et al. |
| 2009/0197192 | A1 | 8/2009 | Hiroko et al. |
| 2013/0252167 | A1 | 9/2013 | Moribe et al. |
| 2014/0004460 | A1 | 1/2014 | Yoshiba et al. |
| 2014/0038098 | A1 | 2/2014 | Naka et al. |
| 2014/0272699 | A1 | 9/2014 | Minaki et al. |
| 2014/0308611 | A1 | 10/2014 | Shimano et al. |
| 2015/0185658 | A1 | 7/2015 | Wakabayashi et al. |
| 2015/0220013 | A1 | 8/2015 | Nishikawa et al. |
| 2016/0139522 | A1 | 5/2016 | Yoshiba et al. |
| 2016/0161874 | A1 | 6/2016 | Yamazaki et al. |
| 2017/0045834 | A1 | 2/2017 | Shirai et al. |
| 2017/0269496 | A1 | 9/2017 | Kubo et al. |
| 2018/0143557 | A1 | 5/2018 | Ueda et al. |
| 2019/0041762 | A1 | 2/2019 | Yoshiba et al. |
| 2019/0041763 | A1 | 2/2019 | Tsuda et al. |

FOREIGN PATENT DOCUMENTS

| | | |
|---|---|---|
| EP | 1 494 087 | 1/2005 |
| EP | 2 626 745 | 8/2013 |
| EP | 2 843 473 | 3/2015 |
| JP | 2000-250264 | 9/2000 |
| JP | 2009-265644 | 11/2009 |
| JP | 2011-094137 | 5/2011 |
| JP | 2013-228724 | 11/2013 |
| JP | 2014-130243 | 7/2014 |
| JP | 2014-222259 | 11/2014 |

OTHER PUBLICATIONS

U.S. Appl. No. 16/438,541, Takeshi Hashimoto, filed Jun. 12, 2019.
U.S. Appl. No. 16/438,544, Kazuhisa Shirayama, filed Jun. 12, 2019.
U.S. Appl. No. 16/438,545, Kenta Kamikura, filed Jun. 12, 2019.
U.S. Appl. No. 16/438,553, Kenji Aoki, filed Jun. 12, 2019.
U.S. Appl. No. 16/438,566, Takashi Matsui, filed Jun. 12, 2019.
U.S. Appl. No. 16/438,611, Hiroki Kagawa, filed Jun. 12, 2019.
U.S. Appl. No. 16/438,623, Tatsuya Saeki, filed Jun. 12, 2019.
Fedors, "A Method for Estimating Both the Solubility Parameters and Molar Volumes of Liquids", Polymer Engineering and Science, vol. 14, No. 2 (1974) 147-54.

* cited by examiner

POSITIVE-CHARGING TONER

BACKGROUND OF THE INVENTION

Field of the Invention

The present invention relates to a positive-charging toner (hereafter also referred to as "toner") used in electrophotography, electrostatic recording and toner jet recording.

Description of the Related Art

In recent years, energy saving has also been addressed as a major technical issue in electrophotographic equipment, with ongoing studies aimed at substantially reducing the amount of heat that acts on fixing devices. Particularly in the case of toners, there is a growing need for so-called "low-temperature fixability", i.e. enabling fixing at a lower energy.

Examples of methods for enabling fixing at low temperature include lowering the glass transition temperature (Tg) of a binder resin in the toner. However, lowering the Tg entails reducing the heat-resistant storability of the toner, and accordingly it is difficult to achieve both low-temperature fixability and heat-resistant storability in the toner by resorting to this method.

Methods in which a crystalline vinyl resin is utilized as a binder resin have thus been studied with a view to achieving both low-temperature fixability and heat-resistant storability in toner. Amorphous resins ordinarily used as binder resins for toners do not exhibit distinct endothermic peaks in differential scanning calorimetry (DSC) measurement, but endothermic peaks appear in measurements by DSC in a case where the resin contains a crystalline resin component.

The side chains of crystalline vinyl resins are arrayed regularly within the molecule, and therefore vinyl resins exhibit the property of undergoing virtually no softening until the melting point is reached. At the demarcation of the melting point vinyl resin crystals melt rapidly and the viscosity of the resin drops sharply as a result. Accordingly, vinyl resins have garnered attention as materials boasting superior sharp melt properties and which combine low-temperature fixability and heat-resistant storability.

Crystalline vinyl resins ordinarily have side chains of long-chain alkyl groups in a main chain skeleton, such that the resin exhibits crystallinity as a result of crystallization of the long-chain alkyl groups in the side chains with each other.

However, the electrical resistance necessary for charging of the resin in an electrophotographic process tends to be difficult to achieve in crystalline resins, given the oriented structure of the resin at the molecular level.

When the desired charging performance fails to be obtained "fogging" is prone to occur in that toner is developed in a non-image area. It is therefore necessary to combine low-temperature fixability and charging performance, at a high level, when the toner contains a given or greater amount of a crystalline resin.

Various proposals have been put forward with the aim of improving the low-temperature fixability, heat-resistant storability or charging performance of crystalline vinyl resins.

Japanese Patent Application Publication No. 2009-265644 proposes a toner that is superior in low-temperature fixability, through the use of a crystalline vinyl resin having a crosslinked structure introduced therein.

Japanese Patent Application Publication No. 2014-130243 proposes a toner in which a crystalline vinyl resin resulting from copolymerization of a polymerizable monomer having a long-chain alkyl group and a polymerizable monomer that forms amorphous segments is used as a binder resin of a toner core.

SUMMARY OF THE INVENTION

However, it was found that the binder resin used in the toner described in Japanese Patent Application Publication No. 2009-265644 is a crystalline vinyl resin resulting from copolymerization of only a polymerizable monomer having a long-chain alkyl group and a crosslinking agent, and the resin has low elasticity around room temperature, due to which the durability of the binder resin is poor.

Moreover, improvements in the charging performance of the toner are not addressed.

The binder resin used in the toner disclosed in Japanese Patent Application Publication No. 2014-130243, by contrast, yields a toner that combines low-temperature fixability and heat-resistant storability, and exhibits sufficient charging performance.

It was however found that the binder resin used in the toner is poor in durability, since the proportion of a structure derived from the polymerizable monomer having a long-chain alkyl group is high and elasticity around room temperature is low. Moreover, charging performance is addressed herein a negatively-changeable toner, and thus there is room for improvement as regards a positively charged toner.

In addition, no proposal is put forward with the aim of achieving both low temperature fixability and charging performance in a positive-charging toner having a crystalline vinyl resin as the main component of a binder resin, while there is a demand for improvements in this respect.

The present invention provides a positive-charging toner that is excellent in low-temperature fixability and heat-resistant storability, and also in durability and charging performance.

The present invention provides a positive-charging toner having a toner particle that contains a binder resin, wherein the binder resin contains a polymer A having a first monomer unit derived from a first polymerizable monomer, and a second monomer unit derived from a second polymerizable monomer that is different from the first polymerizable monomer;

the first polymerizable monomer is at least one selected from the group consisting of (meth)acrylic acid esters having a C18 to C36 alkyl group;

the content of the first monomer unit in the polymer A is 5.0 mol % to 60.0 mol % with respect to the total number of moles of all monomer units in the polymer A;

the content of the second monomer unit in the polymer A is 20.0 mol % to 95.0 mol % with respect to the total number of moles of all monomer units in the polymer A;

assuming that an SP value of the first monomer unit is taken as $SP_{11}$ $(J/cm^3)^{0.5}$ and an SP value of the second monomer unit is taken as $SP_{21}$ $(J/cm^3)^{0.5}$, $$3.00 \leq (SP_{21} - SP_{11}) \leq 25.00 \quad (1)$$

is satisfied, and the work function of the toner is 5.0 eV to 5.4 eV.

The present invention also provides a positive-charging toner having a toner particle that contains a binder resin, wherein the binder resin contains a polymer A, the polymer A is a polymer of a composition that contains a first polymerizable monomer and a second polymerizable monomer that is different from the first polymerizable monomer;

the first polymerizable monomer is at least one selected from the group consisting of (meth)acrylic acid esters having a C18 to C36 alkyl group;

the content of the first polymerizable monomer in the composition is 5.0 mol % to 60.0 mol % with respect to the total number of moles of all polymerizable monomers in the composition;

the content of the second polymerizable monomer in the composition is 20.0 mol % to 95.0 mol % with respect to the total number of moles of all polymerizable monomers in the composition;

assuming that an SP value of the first polymerizable monomer is taken as $SP_{12}$ $(J/cm^3)^{0.5}$ and an SP value of the second polymerizable monomer is taken as $SP_{22}$ $(J/cm^3)^{0.5}$ $$0.60 \leq (SP_{22} - SP_{12}) \leq 15.00 \quad (2)$$

is satisfied; and the work function of the toner is 5.0 eV to 5.4 eV.

The present invention allows providing a positive-charging toner that is excellent in low-temperature fixability and heat-resistant storability, and also in durability and charging performance.

Further features of the present invention will become apparent from the following description of exemplary embodiments with reference to the attached drawings.

DESCRIPTION OF THE EMBODIMENTS

Figure 1A:
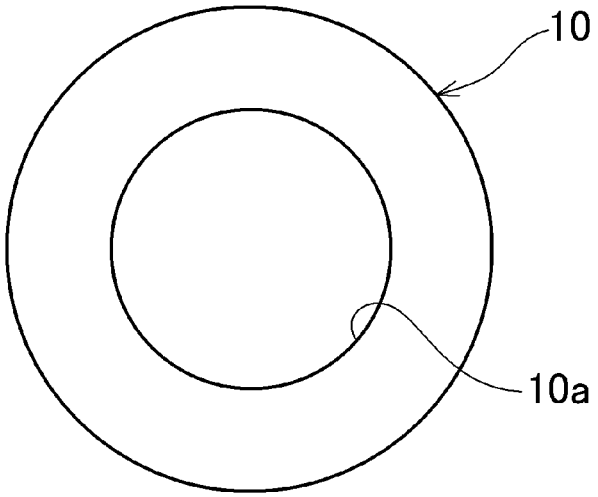
FIG. 1A is a schematic diagram of a cell for powder measurement for a work function.

Unless otherwise stated, the notations "from XX to YY" and "XX to YY" representing a numerical range in the present invention denote a numerical range that includes the lower limit and the upper limit of that range, as endpoints.

In the present invention the term (meth)acrylic acid ester refers to an acrylic acid ester and/or methacrylic acid ester.

In the present invention, the term "monomer unit" denotes one unit in the form of one carbon-carbon bond section, of a polymer, in a main chain resulting from polymerization of a vinyl-based monomer.

The vinyl-based monomer can be represented by Formula (A).

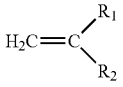

(A)

(Where, $R_1$ represents a hydrogen atom or an alkyl group (preferably a C1 to C3 alkyl group, more preferably a methyl group), and $R_2$ represents any substituent).

The term crystalline resin denotes a resin exhibiting a distinct endothermic peak in a differential scanning calorimetry (DSC) measurement.

Crystalline vinyl resins have ordinarily side chains of long-chain alkyl groups, in a main chain skeleton, and exhibit crystallinity as a result of crystallization of the long-chain alkyl groups in the side chains with each other.

In a case where there is used a crystalline vinyl resin having a long-chain alkyl group, a higher content of the long-chain alkyl group translates into a higher degree of crystallinity, a higher melting point, development of a sharp melt property, and excellent low-temperature fixability.

When the content of the long-chain alkyl group is high however, the elasticity of the crystalline vinyl resin decreases, around room temperature. The toner becomes brittle as a result, and durability is impaired.

Meanwhile, crystallinity decreases significantly and the melting point drops in a case where, with a view to improving on that loss of durability, the polymerizable monomer having a long-chain alkyl group and another polymerizable monomer are copolymerized to reduce the content of the long-chain alkyl group by a given or higher extent. As a result, heat-resistant storability decreases, the sharp melt property is impaired, and low-temperature fixability as well decreases.

The electrical resistance necessary for charging in an electrophotographic process tends to be difficult to achieve in crystalline resins, on account of the oriented structure of the crystalline resins at the molecular level, and thus achieving both low-temperature fixability and charging performance has been thus far a major issue.

In particular, improvements as yet not being addressed are demanded as regards the charging performance of positive-charging toners that utilize a binder resin having a crystalline vinyl resin as a main component.

With a view to resolving the above issues, the inventors studied the types and content of monomer unit having a long-chain alkyl group, as well as the type and content of another monomer unit that make up the polymer used in the binder resin, and also SP value differences between the foregoing monomer unit. The inventors studied control of the work function of the toner as a whole, so as to lie within a specific range, and arrived as a result at the present invention.

The present invention relates to a positive-charging toner having a toner particle that contains a binder resin, wherein the binder resin contains a polymer A having a first monomer unit derived from a first polymerizable monomer, and a second monomer unit derived from a second polymerizable monomer that is different from the first polymerizable monomer;

the first polymerizable monomer is at least one selected from the group consisting of (meth)acrylic acid esters having an alkyl group with 18 to 36 carbons (sometimes referred to as a "C18 to C36 alkyl" group or a "$C_{18-36}$ alkyl" group);

the content of the first monomer unit in the polymer A is 5.0 mol % to 60.0 mol % with respect to the total number of moles of all monomer units in the polymer A;

the content of the second monomer unit in the polymer A is 20.0 mol % to 95.0 mol % with respect to the total number of moles of all monomer units in the polymer A;

assuming that an SP value of the first monomer unit is taken as $SP_{11}$ $(J/cm^3)^{0.5}$ and an SP value of the second monomer unit is taken as $SP_{21}$ $(J/cm^3)^{0.5}$, $$3.00 \leq (SP_{21} - SP_{11}) \leq 25.00 \quad (1)$$

is satisfied, and the work function of the toner is 5.0 eV to 5.4 eV.

The present invention also relates to a positive-charging toner having a toner particle that contains a binder resin, wherein the binder resin contains a polymer A, the polymer A is a polymer of a composition that contains a first polymerizable monomer and a second polymerizable monomer that is different from the first polymerizable monomer;

the first polymerizable monomer is at least one selected from the group consisting of (meth)acrylic acid esters having a C18 to C36 alkyl group;

the content of the first polymerizable monomer in the composition is 5.0 mol % to 60.0 mol % with respect to the total number of moles of all polymerizable monomers in the composition;

the content of the second polymerizable monomer in the composition is 20.0 mol % to 95.0 mol % with respect to the total number of moles of all polymerizable monomers in the composition;

assuming that an SP value of the first polymerizable monomer is taken as $SP_{12}$ $(J/cm^3)^{0.5}$ and an SP value of the second polymerizable monomer is taken as $SP_{22}$ $(J/cm^3)^{0.5}$, $$0.60 \leq (SP_{22} - SP_{12}) \leq 15.00 \quad (2)$$

is satisfied; and the work function of the toner is 5.0 eV to 5.4 eV.

Herein, the term SP value is an abbreviation of solubility parameter, the value of which serves as an indicator of solubility. The method for calculating the SP value will be described further on.

Herein, the binder resin contains a polymer A including a first monomer unit derived from a first polymerizable monomer and a second monomer unit derived from a second polymerizable monomer that is different from the first polymerizable monomer.

The binder resin contains a polymer A being a polymer of a composition containing a first polymerizable monomer and a second polymerizable monomer that is different from the first polymerizable monomer.

The first polymerizable monomer is at least one selected from the group consisting of (meth)acrylic acid esters having a C18 to C36 alkyl group. By virtue of having the first monomer unit the polymer A is a resin exhibiting crystallinity.

If the number of carbon atoms lies within the above range, the melting point of the polymer A is likely to be from 50° C. to 80° C., and good low-temperature fixability and heat-resistant storability are obtained.

Further, Expression (1):

$$3.00 \leq (SP_{21} - SP_{11}) \leq 25.00 \quad (1)$$

is satisfied, assuming that an SP value of the first monomer unit is taken as $SP_{11}$ $(J/cm^3)^{0.5}$ and an SP value of the second monomer unit is taken as $SP_{21}$ $(J/cm^3)^{0.5}$.

Likewise, Expression (2):

$$0.60 \leq (SP_{22} - SP_{12}) \leq 15.00 \quad (2)$$

is satisfied, assuming that an SP value of the first polymerizable monomer is taken as $SP_{12}$ $(J/cm^3)^{0.5}$ and an SP value of the second polymerizable monomer is taken as $SP_{22}$ $(J/cm^3)^{0.5}$.

Preferably, the value of $(SP_{21}-SP_{11})$ is 4.00 $(J/cm^3)^{0.5}$ to 20.00 $(J/cm^3)^{0.5}$, and more preferably 5.00 $(J/cm^3)^{0.5}$ to 15.00 $(J/cm^3)^{0.5}$ Preferably, the value of $(SP_{22}-SP_{12})$ is 2.00 $(J/cm^3)^{0.5}$ to 10.00 $(J/cm^3)^{0.5}$, and more preferably 3.00 $(J/cm^3)^{0.5}$ to 7.00 $(J/cm^3)^{0.5}$.

The units of the SP value in the present invention are $(J/m^3)^{0.5}$, but can be converted to $(cal/cm^3)^{0.5}$ units given that 1 $(cal/cm^3)^{0.5}=2.045\times10^3$ $(J/m^3)^{0.5}$.

The melting point of the polymer A is maintained, without drops in crystallinity, by virtue of the fact that Expression (1) or Expression (2) is satisfied. Both low-temperature fixability and heat-resistant storability are thus achieved.

Conceivable underlying reasons for this include the following.

The first monomer unit are built into the polymer A, which exhibits crystallinity derived from gathering of the first monomer units. In normal cases, however, crystallization is likely to be hampered and the polymer unlikelier to exhibit crystallinity, in a case where another monomer unit is built into the polymer. This tendency becomes noticeable when the first monomer unit and another monomer unit become randomly bonded in one molecule of the polymer.

Through the use of a polymerizable monomer such that $(SP_{22}-SP_{12})$ lies in the range of Expression (2), by contrast, it is deemed that the polymer takes on a polymerized form resulting from polymerization, continuous to some extent, of the first polymerizable monomer and the second polymerizable monomer, without the foregoing polymerizing randomly.

It is considered that when $(SP_{22}-SP_{12})$ lies in the range of Expression (2), the existence of a difference in SP values allows bringing about a phase separation state in the polymer A, at micro-regions, between polymer segments containing mainly the first monomer unit derived from the first polymerizable monomer and polymer segments containing mainly the second monomer unit derived from the second polymerizable monomer.

It is further deemed that by virtue of the fact that $(SP_{21}-SP_{11})$ lies within the range of Expression (1), a distinct phase separation state can be brought about without intermixing of the first monomer unit and the second monomer unit in the polymer A.

It is found that, in consequence, polymer segments can be obtained resulting from polymerization, continuous to some extent, of the first polymerizable monomers, whereby the crystallinity of the polymer segments can be increased and the melting point maintained.

That is, the polymer A preferably has crystalline segments containing the first monomer unit derived from the first polymerizable monomer, and highly polar segments (or amorphous segments) containing the second monomer unit derived from the second polymerizable monomer.

It was found that low-temperature fixability and charging performance could be both achieved in a positive-charging toner, at a high level, by using a binder resin containing the above polymer A. Although the underlying reasons are uncertain, the following can be inferred.

A charging phenomenon occurs ordinarily as a result of electrons moving from a substance having a low work function to a substance having a high work function, whereby an electron donor side becomes positively charged and an electron acceptor side becomes negatively charged.

In the positive-charging toner, therefore, the toner becomes positively charged as a result of transfer of electrons from the toner to for instance a charge-providing member. In order to increase the charge amount of the toner, and do so more rapidly, it is necessary to precisely control the work function of the toner and the flow of electrons at the molecular level.

As described above, a distinct phase separation state can be brought about in the polymer A, without intermixing of crystalline segments containing first monomer unit derived from the first polymerizable monomer and highly polar segments (or amorphous segments) containing second monomer unit derived from the second polymerizable monomer.

The highly polar segments containing the second monomer unit constitute electron supply sites and the crystalline segments containing the first monomer unit constitute electron transfer sites, and in consequence electrons can move quickly and in large amounts of from the toner to the charge-providing member.

It is found that positive chargeability of the toner can be achieved quickly as a result.

In terms of a relationship with respect to the work function of the charge-providing member in an electrophotographic process that utilizes a positive-charging toner, it was found that the extent and speed of electron transfer are maximized in a case where the work function of the toner is 5.0 eV to 5.4 eV.

Toner having a work function lower than 5.0 eV is substantially difficult to obtain, whereas when the work function exceeds 5.4 eV, the toner becomes a substantially negative-charging toner that can no longer be used in an electrophotographic process that utilizes a positive-charging toner.

Preferably, the work function of the toner is 5.0 eV to 5.3 eV.

The problem of achieving both low-temperature fixability and charging performance could be solved, in a positive-charging toner that utilizes a crystalline resin, specifically, through control of the work function of the toner and by adopting a design that takes into account electron transfer in the crystalline resin at the molecular level.

In a case where $(SP_{22}-SP_{12})$ is smaller than 0.60 $(J/cm^3)^{0.5}$, the melting point of the polymer A decreases, and heat-resistant storability drops. Moreover, the difference in polarity between the highly polar segments and the crystalline segments is small, which hinders fast transfer of electrons in large quantities, and detracts from charging performance.

When, on the contrary, $(SP_{22}-SP_{12})$ is larger than 15.00 $(J/cm^3)^{0.5}$, it is deemed that the copolymerizability of the polymer A is impaired, heterogeneity occurs, low-temperature fixability decreases, and the electron transfer speed is likely to decrease.

In a case where $(SP_{21}-SP_{11})$ is smaller than 3.00 $(J/cm^3)^{0.5}$, similarly the melting point of the polymer A decreases, and heat-resistant storability drops. Moreover, the difference in polarity between the highly polar segments and the crystalline segments is small, which hinders fast transfer of electrons in large quantities, and detracts from charging performance.

On the contrary, when $(SP_{21}-SP_{11})$ is larger than 25.00 $(J/cm^3)^{0.5}$, it is deemed that the copolymerizability of the polymer A is impaired, heterogeneity occurs, low-temperature fixability decreases, and electron transfer speed is likely to decrease.

In a case where in the present invention there is a plurality of types of monomer units satisfying the requirement of the first monomer unit in the polymer A, the value of $SP_{11}$ in Expression (1) is the weighted average of the SP values of the respective monomer units. For instance, the SP value $(SP_{11})$ in a case where the polymer A contains A mol % of monomer unit A with a SP value $SP_{111}$ with respect to the number of moles of the totality of monomer units that satisfy the requirement the first monomer unit, and contains (100−A) mol % of monomer unit B with a SP value $SP_{112}$ with respect to the number of moles of the totality of monomer units that satisfy the requirement of the first monomer unit, is given herein by $$SP_{11}=(SP_{111}\times A+SP_{112}\times(100-A))/100$$

A similar calculation is performed in a case where the monomer units satisfying the requirement of the first monomer units is three or more. Likewise, $SP_{12}$ denotes the average value calculated in accordance with the molar ratios of respective first polymerizable monomers.

All monomer units having $SP_{21}$ satisfying Expression (1) with respect to $SP_{11}$ each correspond to the monomer unit derived from the second polymerizable monomer. Similarly, all polymerizable monomers having $SP_{22}$ satisfying Expression (2) with respect to $SP_{12}$ calculated in accordance with the above method, correspond to the second polymerizable monomer.

That is, in a case where the second polymerizable monomer is two or more types of polymerizable monomer, $SP_{21}$ represents SP values of the respective monomer units derived from the polymerizable monomers, and $SP_{21}-SP_{11}$ is established for the monomer units derived from the respective second polymerizable monomers. Likewise, $SP_{22}$ represents the SP values of respective polymerizable monomers, and $SP_{22}-SP_{12}$ is established for respective second polymerizable monomers.

The content of the first monomer unit in the polymer A is 5.0 mol % to 60.0 mol % with respect to the total number of moles of all monomer units in the polymer A.

The content of the first monomer unit is preferably 10.0 mol % to 60.0 mol %, and more preferably 20.0 mol % to 40.0 mol %.

The content of the first polymerizable monomer in the composition is 5.0 mol % to 60.0 mol % with respect to the total number of moles of all polymerizable monomers in the composition.

The content of the first polymerizable monomer is preferably 10.0 mol % to 60.0 mol %, more preferably 20.0 mol % to 40.0 mol %.

The content of the second monomer unit in the polymer A is 20.0 mol % to 95.0 mol % with respect to the total number of moles of all monomer units in the polymer A.

The content of the second monomer unit is preferably 40.0 mol % to 95.0 mol %, and more preferably 40.0 mol % to 70.0 mol %.

The content of the second polymerizable monomer in the composition is 20.0 mol % to 95.0 mol % with respect to the total number of moles of all polymerizable monomers in the composition.

The content of the second polymerizable monomer is preferably 40.0 mol % to 95.0 mol %, and more preferably 40.0 mol % to 70.0 mol %.

In a case where the content of the first monomer unit in the polymer A and the content of the first polymerizable monomer in the composition lie within the above ranges, a sharp melt property can be brought about in the polymer A, and elasticity around room temperature can be maintained. A toner is achieved as a result that is excellent in low-temperature fixability and durability. Further, the toner boasts sufficient crystallinity, and fast electron transfer is made possible.

In a case where the above content is lower than 5.0 mol %, the crystallization amount of the polymer A is small, and the sharp melt property decreases, which translates as a result into a drop in low-temperature fixability. In a case where the content is higher than 60.0 mol %, elasticity around room temperature decreases, and toner durability drops.

In both cases the balance between electron donation sites and potential transfer sites is upset, and it is difficult to achieve sufficient positive chargeability.

In a case where the content of the second monomer unit in the polymer A and the content of the second polymerizable monomer in the composition lie within the above ranges, the elasticity around room temperature of the polymer A can be enhanced while the sharp melt property is preserved, and a toner is obtained that boasts excellent low-temperature fixability and durability. In addition, inhibition of crystallization of the first monomer unit in the polymer A becomes unlikelier, and the melting point can be maintained. Further, a large number of electrons can be donated by the second monomer unit.

In a case where the content is lower than 20.0 mol %, the elasticity of the polymer A drops, and toner durability decreases. If, on the contrary, the content is higher than 95.0 mol %, the sharp melt property of the polymer A drops, and low-temperature fixability decreases.

In both cases the balance between electron donation sites and potential transfer sites is upset, and it becomes difficult to achieve sufficient positive chargeability.

In a case where the polymer A includes a monomer unit derived from two or more types of (meth)acrylic acid ester having a C18 to C36 alkyl group, the content of the first monomer unit denotes herein the total molar ratio including the two or more types. Likewise in a case where the composition used in the polymer A contains two or more types of (meth)acrylic acid ester having a C18 to C36 alkyl group, the content of the first polymerizable monomer denotes the total molar ratio including the two or more types.

In a case where in the polymer A there are present two or more types of monomer units derived from a second polymerizable monomer satisfying Expression (1), the proportion of the second monomer unit denotes the total molar ratio including the two or more types. Also in a case where the composition that is used as the polymer A contains two or more types of second polymerizable monomer, the content of the second polymerizable monomer denotes the total molar ratio including the two or more types.

The first polymerizable monomer is at least one selected from the group consisting of (meth)acrylic acid esters having a C18 to C36 alkyl group.

Examples of (meth)acrylic acid esters having a C18 to C36 alkyl group include (meth)acrylic acid esters having a C18 to C36 linear alkyl group (for instance stearyl (meth) acrylate, nonadecyl (meth)acrylate, eicosyl (meth)acrylate, heneicosanyl (meth)acrylate, behenyl (meth)acrylate, lignoceryl (meth)acrylate, ceryl (meth)acrylate, octacosyl (meth) acrylate, myricyl (meth)acrylate and dotriacontyl (meth) acrylate), and (meth)acrylic acid esters having a C18 to C36 branched alkyl group (for instance 2-decyltetradecyl (meth) acrylate).

Among the foregoing the first polymerizable monomer is preferably at least one selected from the group consisting of (meth)acrylic acid esters having a C18 to C36 linear alkyl group, from the viewpoint of the storage stability of the toner. More preferably, the first polymerizable monomer is at least one selected from the group consisting of (meth) acrylic acid esters having a C18 to C30 linear alkyl group. Yet more preferably, the first polymerizable monomer is at least one selected from the group consisting of linear stearyl (meth)acrylate and linear behenyl (meth)acrylate.

The first polymerizable monomer may be used singly as one type; alternatively, two or more types may be used concomitantly.

Examples of the second polymerizable monomer include polymerizable monomers satisfying Expression (1) or Expression (2), among the polymerizable monomers enumerated below.

The second polymerizable monomer may be used singly as one type; alternatively two, or more types may be used concomitantly.

Monomers having a nitrile group; for instance acrylonitrile and methacrylonitrile.

Monomers having a hydroxy group; for instance 2-hydroxyethyl (meth)acrylate and 2-hydroxypropyl (meth)acrylate.

Monomers having an amide group; for instance acrylamide and monomers obtained through a reaction, in accordance with the known methods, of a C1 to C30 amine and a C2 to C30 carboxylic acid having ethylenically unsaturated bonds (such as acrylic acid and methacrylic acid).

Monomers having a urethane group; for instance monomers obtained through reaction, in accordance with known methods, of a C2 to C22 alcohol having an ethylenically unsaturated bond (for instance 2-hydroxyethyl methacrylate or vinyl alcohol), and a C1 to C30 isocyanate (for instance a monoisocyanate compound (such as benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethyl phenyl isocyanate, 3,5-dimethyl phenyl isocyanate and 2,6-dipropyl phenyl isocyanate); an aliphatic diisocyanate compound, for instance trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate and 2,4,4-trimethyl hexamethylene diisocyanate); an alicyclic diisocyanate compound (1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate and hydrogenated tetramethylxylylene diisocyanate); and an aromatic diisocyanate compound (for instance phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate and xylylene diisocyanate)); and monomers obtained through reaction, in accordance with known methods, of a C1 to C26 alcohol (methanol, ethanol, propanol, isopropyl alcohol, butanol, t-butyl alcohol, pentanol, heptanol, octanol, 2-ethylhexanol, nonanol, decanol, undecyl alcohol, lauryl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol or ercil alcohol) and a C2 to C30 isocyanate having an ethylenically unsaturated bond (for instance 2-isocyanatoethyl (meth)acrylate, 2-(0-[1'-methylpropylideneamino] carboxyamino)ethyl (meth)acrylate, 2-[(3,5-dimethylpyrazolyl)carbonylamino]ethyl (meth)acrylate, and 1,1-(bis (meth)acryloyloxymethyl)ethyl isocyanate)).

Monomers having a urea group; for instance monomers obtained through reaction, in accordance with known methods, of a C3 to C22 amine (primary amine (for instance n-butyl amine, t-butyl amine, propyl amine and isopropyl amine), or a secondary amine (for instance di-n-ethyl amine, di-n-propyl amine and di-n-butyl amine), with a C2 to C30 isocyanate having an ethylenically unsaturated bond.

Monomers having a carboxy group; for instance methacrylic acid, acrylic acid and 2-carboxyethyl (meth)acrylate.

Among the foregoing there is preferably used a monomer having a nitrile group, an amide group, a urethane group, a hydroxy group or a urea group. More preferably, the second polymerizable monomer is a monomer having an ethylenically unsaturated bond and at least one functional group selected from the group consisting of a nitrile group, an amide group, a hydroxy group, a urethane group, and a urea group.

By virtue of having the foregoing, the polymer A is likely to exhibit a high melting point, and to exhibit heat-resistant storability that is readily enhanced. Also, elasticity around room temperature is increased, and durability is also increased.

Preferred examples of the second polymerizable monomer include vinyl esters such as vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate and vinyl octylate. Vinyl esters are non-conjugated monomers, and readily exhibit moderate reactivity towards the first polymerizable monomer. It is deemed that a state is readily brought about as a result, in the polymer A, in which the monomer unit derived from the first polymerizable monomer gather and become bonded to each other, so that the crystallinity of the polymer A increases, and both low-temperature fixability and heat-resistant storability are achieved yet more readily.

The second polymerizable monomer preferably has ethylenically unsaturated bonds, and more preferably has one ethylenically unsaturated bond.

The second polymerizable monomer preferably is at least one selected from the group consisting of Formulae (A) and (B)

(A)

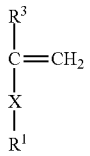

(B)

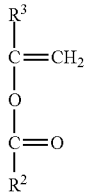

Where, X represents a single bond or a C1 to C6 alkylene group.

Further, $R^1$ represents a nitrile group (—C≡N), an amide group (—C(=O)NHR$^{10}$, where $R^{10}$ is a hydrogen atom or a C1 to C4 alkyl group), a hydroxy group, —COOR$^{11}$ (where $R^{11}$ is a C1 to C6 (preferably a C1 to C4) alkyl group, or a C1 to C6 (preferably a C1 to C4) hydroxyalkyl group), a urethane group (—NHCOOR$^{12}$, where $R^{12}$ is a C1 to C4 alkyl group), a urea group (—NH—C(=O)—N(R$^{13}$)$_2$, where $R^{13}$ are each independently a hydrogen atom or a C1 to C6 (preferably a C1 to C4) alkyl group), —COO(CH$_2$)$_2$NHCOOR$^{14}$ (where $R^{14}$ is a C1 to C4 alkyl group), or —COO(CH$_2$)$_2$—NH—C(=O)—N(R$^{15}$)$_2$ (where $R^{15}$ are each independently a hydrogen atom or a C1 to C6 (preferably a C1 to C4) alkyl group).

Preferably, $R^1$ is a nitrile group (—C≡N), an amide group (—C(=O)NHR$^{10}$, where $R^{10}$ is a hydrogen atom or a C1 to C4 alkyl group), a hydroxy group, —COOR$^{11}$ (where $R^{11}$ is a C1 to C6 (preferably a C1 to C4) alkyl group, or a C1 to C6 (preferably a C1 to C4) hydroxyalkyl group), a urea group (—NH—C(=O)—N(R$^{13}$)$_2$, where $R^{13}$ are each independently a hydrogen atom or a C1 to C6 (preferably a C1 to C4) alkyl group), —COO(CH$_2$)$_2$NHCOOR$^{14}$ (where $R^{14}$ is a C1 to C4 alkyl group), or —COO(CH$_2$)$_2$—NH—C(=O)—N(R$^{15}$)$_2$ (where $R^{15}$ are each independently a hydrogen atom or a C1 to C6 (preferably a C1 to C4) alkyl group).

Herein $R^2$ represents a C1 to C4 alkyl group, and $R^3$ represent each independently a hydrogen atom or a methyl group.

The polymer A is preferably a vinyl polymer. Examples of the vinyl polymer include for instance polymers of monomers having an ethylenically unsaturated bond. The term ethylenically unsaturated bond denotes a carbon-carbon double bond capable of undergoing radical polymerization, and may be for instance a vinyl group, a propenyl group, an acryloyl group or a methacryloyl group.

The polymer A may contain a third monomer unit derived from a third polymerizable monomer different from the first polymerizable monomer and from the second polymerizable monomer, so long as the above-described molar ratio of the first monomer unit derived from the first polymerizable monomer and the second monomer unit derived from second polymerizable monomer is observed.

The composition containing the first polymerizable monomer and the second polymerizable monomer different from the first polymerizable monomer may contain a third polymerizable monomer different from the first polymerizable monomer and from the second polymerizable monomer, so long as the content of the first polymerizable monomer and the content of the second polymerizable monomer in the composition are observed.

In that case, it is preferable to satisfy Formula (3) below, assuming that an SP value of the third monomer unit is taken as $SP_{31}$ (J/cm$^3$).

$$0.00<(SP_{31}-SP_{11})<3.00 \quad (3)$$

Preferably, it is further preferable to satisfy the relationship of Formula (4) below, assuming that an SP value of the third polymerizable monomer is taken as $SP_{32}$ (J/cm$^3$)$^{0.5}$.

$$0.00<(SP_{32}-SP_{12})<0.60 \quad (4)$$

A monomer satisfying Formula (3) or Formula (4), from among the monomers exemplified above as the second polymerizable monomers, may be used herein as the third polymerizable monomer.

All monomer units having $SP_{31}$ satisfying Formula (3) with respect to $SP_{11}$ correspond to the monomer unit derived from the third polymerizable monomer. Similarly, all polymerizable monomers having $SP_{32}$ satisfying Formula (4) with respect to $SP_{12}$ correspond to the third polymerizable monomer.

That is, in a case where the third polymerizable monomer is two or more types of polymerizable monomer, $SP_{31}$ represents SP values of the respective monomer units derived from the polymerizable monomers, and $SP_{31}-SP_{11}$ is established for the monomer units derived from the respective third polymerizable monomers. Likewise, $SP_{32}$ represents the SP values of respective polymerizable monomers, and $SP_{32}-SP_{12}$ is established for respective second polymerizable monomers.

Examples of third polymerizable monomers that can be used include for instance the following.

Styrene and derivatives thereof such as styrene and o-methylstyrene, as well as (meth)acrylic acid esters such a methyl (meth)acrylate, n-butyl (meth)acrylate, t-butyl (meth)acrylate and 2-ethylhexyl (meth)acrylate.

The above monomers do not have polar groups, and accordingly exhibit a low SP value, which makes the monomers unlikely to satisfy Expression (1) or Expression (2). In a case however where the monomers satisfy Expression (1) or Expression (2), the monomers can be used as the second polymerizable monomer.

The third polymerizable monomer is preferably at least one selected from the group consisting of styrene, methyl methacrylate and methyl acrylate, in terms of improving toner storability.

The polymer A may include fourth monomer unit derived from a fourth polymerizable monomer different from the first polymerizable monomer, the second polymerizable monomer and the third polymerizable monomer.

The fourth monomer unit preferably contain a monomer unit derived from a macromonomer.

The term macromonomer signifies a polymer having, at an end thereof, a functional group capable of acting as a monomer molecule, such that the polymer constitutes only one type of monomer unit in the polymer that is produced.

The macromonomer preferably has an acryloyl group or a methacryloyl group at the molecular chain end. Methacryloyl groups copolymerize readily, and accordingly are more preferable herein.

The number-average molecular weight of the macromonomer is preferably 1,000 to 20,000.

The first polymerizable monomer, the second polymerizable monomer and the third polymerizable monomer are polymerizable monomers having an number-average molecular weight lower than 1,000, and hence do not come under the above definition of macromonomer.

The content of the monomer unit derived from the macromonomer in the polymer A is preferably $1.0\times10^{-4}$ mol % to $3.0\times10^{-1}$ mol %, and more preferably $1.0\times10^{-3}$ mol % to $1.0\times10^{-2}$ mol % with respect to the total number of moles of all monomer units in the polymer A.

When the content of the monomer unit derived from the macromonomer lies within the above ranges, the below-described effects are sufficiently brought out, and heterogeneity during polymerization is readily suppressed.

The number of moles of the macromonomer or the monomer unit derived from the macromonomer is calculated on the basis of the number-average molecular weight (Mn) of the macromonomer.

The content of the macromonomer in the polymer A is preferably 0.01 parts by mass to 1.0 parts by mass, and more preferably 0.1 parts by mass to 1.0 parts by mass, with respect to 100 parts by mass as all polymerizable monomers in the composition.

The macromonomer is a linear high molecular weight monomer, comparatively long, having a number-average molecular weight of 1,000 to 20,000, and having a polymerizable functional group (for instance an unsaturated group such as a carbon-carbon double bond) at a molecular chain end.

In a case where the polymer A include a monomer unit derived from the macromonomer, branches form in a long linear molecule derived from such monomer units in the molecular chain.

A micro-phase-separated structure can be readily achieved through self-aggregation of the monomer unit having the above long linear molecule. As a result, a first monomer unit can become readily oriented, and the polymer is likely to hold crystalline segments. The electron transfer speed is further increased, and positive charging rising becomes faster, also for instance in high-temperature/high-humidity environments where charging performance is more demanding.

In a case where the number-average molecular weight of the macromonomer is 1,000 to 20,000, branched-structure portions (also referred to as graft structure portions) move readily, and a micro-phase-separated structure is readily achieved.

Examples of components that makes up such long linear molecules include polymers obtained through polymerization of a single type, or two or more types, from among styrene, styrene derivatives, methacrylic acid esters, acrylic acid esters, acrylonitrile, methacrylonitrile and the like; as well as components having a polysiloxane skeleton.

Among the foregoing, the macromonomer is preferably at least one selected from the group consisting of (meth)acrylic acid ester polymers having an acryloyl group or a methacryloyl group at a molecular chain end. Cohesiveness is increased, and crystalline segments of the first monomer unit can be held more readily by using a (meth)acrylic acid ester polymer.

The toner preferably contains at least one selected from the group consisting of a positive-charging charge control agent and a positive-charging charge control resin.

The work function of the toner as a whole becomes easier to control by using a positive-charging charge control agent or a positive-charging charge control resin, and adjusting the addition amount of the foregoing. The positive-charging charge control agent and the positive-charging charge control resin constitute electron donation sites, and accordingly there is obtained a greater charge amount.

Examples of the positive-charging charge control agent include for instance nigrosine dyes, quaternary ammonium salts, triaminotriphenylmethane compounds and imidazole compounds.

Examples of the positive-charging charge control resin include polyamine resins, quaternary ammonium group-containing copolymers, and quaternary ammonium base-containing copolymers. A charge control resin having good dispersibility in toner is preferred among the foregoing, and yet more preferably, a quaternary ammonium base-containing copolymer (for example, a quaternary ammonium base-containing styrene acrylic resin).

The work function of the toner is readily influenced by the surface of the toner particles, and hence the positive-charging charge control agent or charge control resin is preferably present on the outermost surface of the toner particle.

For instance in toners having a core-shell structure, the positive-charging charge control agent or charge control resin is preferably contained in a shell agent.

The content of the charge control agent and/or charge control resin is preferably 0.01 parts by mass to 10 parts by mass, and more preferably 0.03 parts by mass to 8 parts by mass, with respect to 100 parts by mass of the binder resin. The charge control agent and the charge control resin can be used singly, or in combinations or two or more types.

The toner particle may contain a release agent.

Examples of release agents include for instance waxes having a fatty acid ester as a main component, such as carnauba wax and montanic acid ester wax; waxes obtained by deacidifying part or the entirety of the acid component of fatty acid esters, such as deacidified carnauba wax; methyl ester compounds having a hydroxy group, and obtained by hydrogenation of vegetable oils or the like; saturated fatty acid monoesters such as stearyl stearate and behenyl behenate; diesters of saturated aliphatic dicarboxylic acids and saturated aliphatic alcohols, such as dibehenyl sebacate, distearyl dodecanedioate, distearyl octadecanedioate; diesters of saturated aliphatic diols and saturated fatty acids, such as nonanediol dibehenate and dodecanediol distearate; low molecular weight polyethylene; low molecular weight polypropylene; aliphatic hydrocarbon waxes such as microcrystalline wax, paraffin wax and Fischer Tropsch wax; oxides of aliphatic hydrocarbon waxes such as oxidized polyethylene wax, or block copolymers of the oxides; waxes resulting from grafting a vinyl monomer such as styrene or acrylic acid to an aliphatic hydrocarbon wax; saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linoleamide, oleamide and lauramide; saturated fatty acid bisamides such as methylene bis(stearamide), ethylene bis(capramide), ethylene bis(lauramide) and hexamethylene bis(stearamide); unsaturated fatty acid amides such as ethylene bis(oleamide), hexamethylene bis(oleamide), N,N'-dioleyl adipamide and N,N'-dioleyl sebacamide; aromatic bisamides such as m-xylene bis(stearamide), N,N'-distearyl isophthalamide; aliphatic metal salts (generally referred to as metal soaps) such as calcium stearate, calcium laurate, zinc stearate and magnesium stearate; and long-chain alkyl alcohols or long-chain alkyl carboxylic acids having 12 or more carbon atoms.

The content of the release agent in the toner particle is preferably 1.0 mass % to 30.0 mass %, and more preferably 2.0 mass % to 25.0 mass %.

The weight-average molecular weight (Mw) of tetrahydrofuran (THF)-soluble fraction of the polymer A, as measured by gel permeation chromatography (GPC), is preferably 10,000 to 200,000, and more preferably 20,000 to 150,000.

Elasticity around room temperature can be readily maintained when the weight-average molecular weight (Mw) lies in the above range.

The melting point of the polymer A is preferably 50° C. to 80° C., and more preferably 53° C. to 70° C. Low-temperature fixability and heat-resistant storability are further enhanced in a case where the melting point lies in the above range.

The melting point of the polymer A can be adjusted for instance on the basis of the type and amount the first polymerizable monomer or the type or amount of the second polymerizable monomer that are used.

The content of the polymer A in the binder resin is preferably 50.0 mass % or higher.

The sharp melt property of the toner is readily maintained, and low-temperature fixability enhanced, when the content of the polymer A is 50.0 mass % or higher. Further, positive chargeability can be obtained more stably.

The content is more preferably 80.0 mass % to 100.0 mass %; yet more preferably, the binder resin is the polymer A.

Examples of resins that can be used as the binder resin, other than the polymer A, include conventionally known vinyl resins, polyester resins, polyurethane resins and epoxy resins. Among the foregoing the binder is preferably a vinyl resin, a polyester resin or a polyurethane resin, in terms of electrophotographic characteristics.

Examples of polymerizable monomers that can be used in the vinyl resin include the above-described first polymerizable monomer, second polymerizable monomer and third polymerizable monomer. Two or more types thereof may be combined herein as needed.

The polyester resin can be obtained through reaction between a divalent or higher polyvalent carboxylic acid and a polyhydric alcohol.

Examples of polyvalent carboxylic acids include for instance the following compounds: dibasic acids such as succinic acid, adipic acid, sebacic acid, phthalic acid, isophthalic acid, terephthalic acid, malonic acid and dodecenyl succinic acid, as well as anhydrides or lower alkyl esters thereof, aliphatic unsaturated dicarboxylic acids such as maleic acid, fumaric acid, itaconic acid and citraconic acid; as well as 1,2,4-benzenetricarboxylic acid, 1,2,5-benzenetricarboxylic acid and anhydrides and lower alkyl esters thereof. The foregoing may be used singly; alternatively, two or more types thereof may be used concomitantly.

The following compounds may be used as a polyvalent alcohol: alkylene glycols (ethylene glycol, 1,2-propylene glycol or 1,3-propylene glycol); alkylene ether glycols (polyethylene glycol or polypropylene glycol); alicyclic diols (1,4-cyclohexane dimethanol); bisphenols (bisphenol A); and adducts of alicyclic diols and alkylene oxides (ethylene oxide and propylene oxide). The alkyl moiety in alkylene glycols and alkylene ether glycols may be linear or branched. Further examples include glycerin, trimethylol ethane, trimethylolpropane and pentaerythritol. The foregoing may be used singly; alternatively, two or more types thereof may be used concomitantly.

For the purpose of adjusting the acid value or hydroxyl value, there can be used a monovalent acid such as acetic acid or benzoic acid, and a monohydric alcohol such as cyclohexanol or benzyl alcohol, as needed.

The method for producing the polyester resin is not particularly limited, and can be for instance transesterification or direct polycondensation, singly or in combination.

Polyurethane resins will be described next. Polyurethane resins are reaction products of a diol and a substance containing a diisocyanate group, such that the resulting resin can exhibit various functionalities through adjustment of the diol and the diisocyanate.

Examples of diisocyanate components include the following. Aromatic diisocyanates having from 6 to 20 carbon atoms (excluding the carbon in the NCO group; likewise hereafter), aliphatic diisocyanates having from 2 to 18 carbon atoms, alicyclic diisocyanates having from 4 to 15 carbon atoms, as well as modified products of the foregoing diisocyanates (modified products containing a urethane group, carbodiimide group, allophanate group, urea group, biuret group, uretdione group, uretoimine group, isocyanurato group or oxazolidone group; hereafter also referred to as "modified diisocyanate"), and also mixtures of two or more of the foregoing.

Examples of aromatic diisocyanates include for instance the following: m- and/or p-xylylene diisocyanate (XDI), and α,α,α',α'-tetramethyl-xylylene diisocyanate.

Examples of aliphatic diisocyanates include for instance the following: ethylene diisocyanate, tetramethylene diisocyanate, hexamethylene diisocyanate (HDI) and dodecamethylene diisocyanate.

Examples of alicyclic diisocyanates include for instance the following: isophorone diisocyanate (IPDI), dicyclohexylmethane-4,4'-diisocyanate, cyclohexylene diisocyanate and methylcyclohexylene diisocyanate.

Preferred among the foregoing are aromatic diisocyanates having from 6 to 15 carbon atoms, aliphatic diisocyanates having from 4 to 12 carbon atoms, and alicyclic diisocyanates having from 4 to 15 carbon atoms, and particularly preferably XDI, IPDI and HDI.

A trifunctional or higher functional isocyanate compound can also be used in addition to the diisocyanate component.

Examples of diol components that can be used in the polyurethane resin include components identical to the above-described divalent alcohols that can be used in a polyester resin.

The toner particle may contain a colorant. Examples of the colorant include known organic pigments, organic dyes, inorganic pigments, carbon black as a black colorant, and magnetic materials. Apart from the foregoing, also colorants that are utilized in conventional toners can be used herein.

Examples of yellow colorants include the following: condensed azo compounds, isoindolinone compounds, anthraquinone compounds, azo metal complexes, methine compounds and allylamide compounds. Specifically, C.I. Pigment Yellow 12, 13, 14, 15, 17, 62, 74, 83, 93, 94, 95, 109, 110, 111, 128, 129, 147, 155, 168 or 180 is preferably used.

Examples of magenta colorants include the following: condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 or 254 is preferably used.

Examples of cyan colorants include the following: copper phthalocyanine compounds and derivatives thereof, anthraquinone compounds and basic dye lake compounds. Specifically, C.I. Pigment Blue 1, 7, 15, 15:1, 15:2, 15:3, 15:4, 60, 62 or 66 is preferably used.

The colorant is selected in terms of hue angle, chroma, lightness, light resistance, OHP transparency, and dispersibility in toner.

The content of the colorant is preferably 1.0 parts by mass to 20.0 parts by mass with respect to 100.0 parts by mass of the binder resin. In a case where a magnetic material is used as the colorant, the addition amount of the magnetic material is preferably 40.0 parts by mass to 150.0 parts by mass with respect to 100.0 parts by mass of the binder resin.

The form of the toner particle may be a core-shell structure in which a shell is formed on the surface of a core particle.

The method for forming the core-shell structure is not particularly limited, and for instance a polymerization layer constituting the shell may be formed through suspension polymerization of a polymerizable monomer for a shell, in the presence of a core particle.

As the polymerizable monomer for a shell there is preferably used a monomer that forms a polymer having a glass transition temperature in excess of 70° C., such as styrene or methyl methacrylate, singly or in combinations or two or more types. Methyl methacrylate is more preferable herein.

The glass transition temperature of the polymer obtained from the polymerizable monomer for a shell is preferably 50° C. to 120° C., more preferably 60° C. to 110° C., and yet more preferably 70° C. to 105° C., with a view to improving the storability of the toner.

The shell may contain a thermosetting resin, from the viewpoint of heat resistance.

Examples of the thermosetting resin include the following.

Melamine resins, urea resins, sulfonamide resins, glyoxal resins, guanamine resins, aniline resins, and derivatives of these resins.

Polyimide resins: maleimide polymers such as bismaleimide, aminobismaleimide and bismaleimide triazine.

Resins (hereafter referred to as aminoaldehyde resins) produced by polycondensation of a compound containing an amino group with an aldehyde (for instance formaldehyde), or derivatives of aminoaldehyde resins.

Melamine resins are polycondensates of melamine and formaldehyde. Urea resins are polycondensates of urea and formaldehyde. Glyoxal resins are polycondensates of formaldehyde and a reaction product of glyoxal and urea. Dimethylol dihydroxyethylene urea (DMDHEU) is preferred herein as the glyoxal resin.

The crosslinking curing function of the thermosetting resin can be enhanced by incorporating nitrogen into the thermosetting resin. In order to increase the reactivity of the thermosetting resin, the content of nitrogen is preferably adjusted to be from 40 mass % to 55 mass %, in a melamine resin, to about 40 mass % in a urea resin, and to about 15 mass % in a glyoxal resin.

One or more thermosetting monomers selected from the group consisting of methylolmelamine, melamine, methylolated urea, urea, benzoguanamine, acetoguanamine and spiroguanamine can be used to prepare the thermosetting resin included in the shell.

A curing agent or a reaction accelerator, or a polymer resulting from combining a plurality of functional groups may be used to form the shell. Water resistance may be enhanced by using an acrylic silicone resin (graft polymer).

The thickness of the shell is preferably 20 nm or less, and is more preferably from 3 nm to 20 nm. Formation of the shell is carried out preferably in an aqueous medium, and preferably the material of the shell is water-soluble.

In order to form a shell from a thermosetting resin, preferably, the core particle is anionic and the shell is cationic. An anionic core particle allows the cationic shell material to be attracted to the surface of the core particle during formation of the shell.

Specifically, for instance a positively charged shell material is electrically attracted, in an aqueous medium, to a negatively charged core particle in the aqueous medium; a shell becomes thereupon formed on of the surface of the core particle through in-situ polymerization. A uniform shell is readily formed as a result on the surface of the core particle, without excessive dispersion of the core particle in the aqueous medium using a dispersing agent.

In order to control the work function of the toner, the shell preferably contains a positive-charging charge control agent and/or positive-charging charge control resin.

The toner preferably contains an external additive in order to improve charging stability, developing performance, flowability and durability. Examples of the external additive include inorganic fine particles such as silica fine particles, metal oxide fine particles (such as alumina fine particles, titanium oxide fine particles, magnesium oxide fine particles, zinc oxide fine particles, strontium titanate fine particles and barium titanate fine particles).

Also organic fine particles made up of for instance a vinyl resin, a silicone resin or a melamine resin, and organic-inorganic composite fine particles, may be used herein.

The content of the external additive is preferably 0.1 parts by mass to 4.0 parts by mass, and more preferably 0.2 parts by mass to 3.5 parts by mass, with respect to 100.0 parts by mass of the toner particle.

The external additive is preferably subjected to a surface treatment, in order to control the work function of the toner. In the case for instance where silica particles are used as the external additive particles, preferably positive chargeability is imparted to the surface of the silica particles by a surface treatment agent.

Examples of the surface treatment agent include treatment agents such as silicone varnishes, various modified silicone varnishes, unmodified silicone oils, various modified silicone oils, silane compounds, silane coupling agents, other organosilicon compounds, and organotitanium compounds. The foregoing may be used singly or concomitantly.

Among the foregoing, the external additive is preferably treated with a silicone oil or silane compound having a substituent containing nitrogen (in particular an amino group), in terms of controlling the toner work function.

Concrete examples of surface treatment agents having an amino group include amino group-containing coupling agents and amino-modified silicone oils that are modified through introduction of an amino group in a side chain or terminus of a silicone oil.

The treated amount through the use of a surface treatment agent is preferably set to 0.02 parts by mass to 10 parts by mass, more preferably 0.05 parts by mass to 5 parts by mass, and yet more preferably 0.1 parts by mass to 2 parts by mass, with respect to 100 parts by mass of the external additive.

In a case where the toner is envisaged to be made into a two-component developer through mixing with a magnetic carrier, for use in a two-component developing system, it is preferable that the external additive has a conductive layer on the surface.

In two-component developing systems charge is provided through the use of a magnetic carrier; however, charging by the magnetic carrier tends to result in a broad charge distribution, and makes fogging prone to occur. Therefore, excessive charging of the toner can be suppressed, and the charge distribution can be made sharper, by using herein an external additive having a conductive layer on the surface.

Preferably, the conductive layer is a film-forming body that contains tin oxide ($SnO_2$) doped with antimony (Sb). Electron mobility can be increased thanks to the presence of the conductive layer, so that charge rising performance and a sharp charge distribution can be both achieved as a result.

Preferably, the volume resistivity of the external additive having the conductive layer is about $1.0\times10^0$ Ω·cm to $1.0\times10^7$ Ω·cm. The number-average particle diameter of the primary particles of the external additive having the conductive layer is preferably 0.01 μm to 1.00 μm, and more preferably 0.10 μm to 0.80 μm.

A concrete method for applying the conductive layer will be explained next, taking titanium oxide as an example.

Firstly a mixture of titanium tetrachloride and oxygen gas obtained in accordance with a chlorine method is introduced into a gas-phase oxidation reactor and is caused to react in a gas phase at a temperature of 1000° C., to yield bulk titanium oxide. The obtained bulk titanium oxide is pulverized using for instance a hammer mill, and thereafter is washed and dried at a temperature of 110° C., followed by crushing in a jet mill or the like, to yield titanium oxide fine particles.

The number-average particle diameter of the primary particles of titanium oxide can be adjusted herein through modification of the conditions of pulverization of the bulk titanium oxide using for instance a hammer mill.

Next, the titanium oxide fine particles are dispersed in water to a concentration of about 50 g/L, sodium pyrophosphate is further added, and the whole is wet-pulverized in a sand mill or the like, to thereby prepare a water-soluble slurry.

The obtained water-soluble slurry is heated to 80° C., and thereafter a mixed solution of an appropriate amount of tin chloride ($SnCl_4.5H_2O$) and antimony chloride ($SbCl_3$) dissolved in a 2 mol/L hydrochloric acid solution (300 mL), and a 10 mass % sodium hydroxide solution, are added over 60 minutes while pH is maintained at 6 to 9, to form a coating film containing tin oxide doped with antimony, as a conductive layer, on the surface of the titanium oxide fine particles, and yield thereby titanium oxide fine particles having a conductive layer.

Within the ranges of the present configuration, the toner particle may be produced in accordance with any conventionally known method, such as suspension polymerization, emulsion aggregation, dissolution suspension, or pulverization, but preferably the toner particle is produced in accordance with a suspension polymerization method.

For instance, a polymerizable monomer composition is obtained through mixing of a polymerizable monomer that generates a binder resin containing the polymer A, and also, as needed, other additives such as a release agent and a colorant. Thereafter, the polymerizable monomer composition is added to an aqueous medium (optionally containing a dispersion stabilizer, as needed). Particles of the polymerizable monomer composition are formed in the aqueous medium, and the polymerizable monomers contained in the particles are polymerized. A toner particle can be obtained as a result.

Methods for measuring various physical properties according to the present invention will be explained next.

<Method for Measuring the Content of Monomer Units Derived from Various Polymerizable Monomers in the Polymer A>

The content of the monomer units derived from various polymerizable monomers in the polymer A is measured by $^1$H-NMR under the following conditions.

Measuring device: FT NMR device JNM-EX400 (by JEOL Ltd.)
Measurement frequency: 400 MHz
Pulse condition: 5.0 μs
Frequency range: 10500 Hz
Integration count: 64 times
Measurement temperature: 30° C.
Sample: the sample is prepared by placing 50 mg of a measurement sample in a sample tube having an inner diameter of 5 mm, with addition of deuterated chloroform ($CDCl_3$) as a solvent, followed by dissolution in a thermostatic bath at 40° C.

From among the peaks attributed to the constituent elements of the monomer unit derived from the first polymerizable monomer there are selected, on the basis of the obtained $^{1}$H-NMR chart, peaks independent from peaks attributed to constituent elements of a monomer unit otherwise derived, and an integration value $S_1$ of the selected peaks is calculated.

From among the peaks attributed to constituent elements of a monomer unit derived from the second polymerizable monomer there are similarly selected peaks independent from peaks attributed to constituent elements of a monomer unit otherwise derived, and an integration value $S_2$ of the selected peaks is calculated.

In a case where third and fourth polymerizable monomers are used, from among the peaks attributed to the constituent elements of the monomer unit derived from the third and fourth polymerizable monomers there are selected peaks independent from peaks attributed to constituent elements of the monomer unit otherwise derived, and integration values $S_3$ and $S_4$ of the selected peaks are calculated.

The content of the monomer unit derived from the first polymerizable monomer is worked out as described below using the above integration values $S_1$, $S_2$, $S_3$ and $S_4$. Herein $n_1$, $n_2$, $n_3$ and $n_4$ are the number of hydrogens among the constituent elements to which there are attributed the peaks of interest for each site.

$$\text{Content (mol \%) of monomer unit derived from the first polymerizable monomer}=\{(S_1/n_1)/((S_1/n_1)+(S_2/n_2)+(S_3/n_3)+(S_4/n_4))\}\times 100$$

The content of the monomer unit derived from the second polymerizable monomer, the third polymerizable monomer and the fourth polymerizable monomer are worked out in a similar way, as follows.

$$\text{Content (mol \%) of monomer unit derived from the second polymerizable monomer}=\{(S_2/n_2)/((S_1/n_1)+(S_2/n_2)+(S_3/n_3)+(S_4/n_4))\}\times 100$$

$$\text{Content (mol \%) of monomer unit derived from the third polymerizable monomer}=\{(S_3/n_3)/((S_1/n_1)+(S_2/n_2)+(S_3/n_3)+(S_4/n_4))\}\times 100$$

$$\text{Content (mol \%) of monomer unit derived from the fourth polymerizable monomer}=\{(S_4/n_4)/((S_1/n_1)+(S_2/n_2)+(S_3/n_3)+(S_4/n_4))\}\times 100$$

In a case where in the polymer A there is used a polymerizable monomer that contains no hydrogen in constituent elements other than a vinyl group, the above content is calculated in the same way as in $^{1}$H-NMR, but herein resorting to $^{13}$C-NMR using $^{13}$C as the measurement nucleus, in a single-pulse mode.

In a case where the toner particle is produced in accordance with a suspension polymerization method, the peaks of the release agent and the peaks of other resins may overlap each other, and it may not be possible to observe independent peaks. In consequence, the content of monomer units derived from various polymerizable monomers in the polymer A may in some instances be impossible to calculate. In such a case a polymer A' can be similarly produced by suspension polymerization, but without using a release agent and other resin, the polymer A' being then analyzed as the polymer A.

<Method for Calculating SP Values>

Herein $SP_{12}$, $SP_{22}$ and $SP_{32}$ are worked out as described below, in accordance with the calculation method proposed by Fedors.

The evaporation energy (Δei) (cal/mol) and molar volume (Δvi) (cm$^3$/mol) of the atoms or atomic groups of the molecular structure in each polymerizable monomer are worked out on the basis of the tables given "Polym. Eng. Sci., 14 (2), 147-154 (1974)", where $(4.184\times\Sigma\Delta ei/\Sigma\Delta vi)^{0.5}$) is the SP value $(J/cm^3)^{0.5}$.

Further, $SP_{11}$, $SP_{21}$ and $SP_{31}$ are calculated in accordance with the same calculation method, for the atoms or atomic groups in the molecular structure, in a state where the double bonds of the polymerizable monomer have been cleaved through polymerization.

<Method for Measuring the Work Function of Toner>

The work function of toner is measured in accordance with the measurement method below.

The work function is quantified as the energy (eV) for removing electrons from a substance.

The work function is measured using a surface analyzer (AC-2 by Riken Keiki Co., Ltd.).

In this device, a sample is irradiated using a deuterium lamp, with a set value of irradiation dose of 800 nW, monochromatic light selected by a spectrometer, and with a spot size of 4 (mm)×4 (mm), an energy scanning range of 3.6 to 6.2 (eV), an anode voltage of 2910 V, and a measurement time of 10 (sec/1 point).

Photoelectrons emitted from the sample surface are detected, and a calculation process is executed using work function calculation software that is built into the surface analyzer. The work function is measured repeatedly with a precision (standard deviation) of 0.02 (eV). In a case where a powder is to be measured there is used a cell for powder measurement.

Figure 1B:
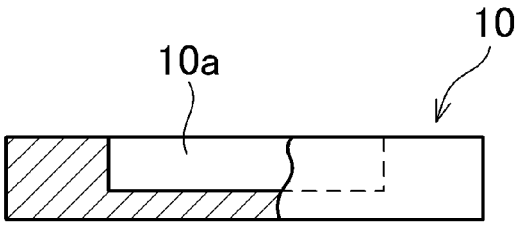
FIG. 1B is a schematic diagram of a cell for powder measurement for a work function.
Figure 1C:
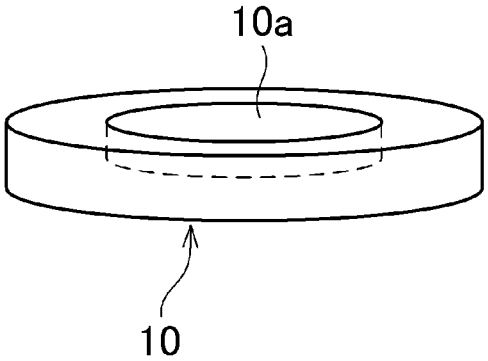
FIG. 1C is a schematic diagram of a cell for powder measurement for a work function.

FIGS. 1A to 1C are schematic diagrams of a cell for powder measurement. FIG. 1A is a plan-view diagram of a cell 10, FIG. 1B is a partial cutaway side-view diagram, and FIG. 1C is a perspective-view diagram. The cell 10 has a sample accommodating recess 10*a* having a diameter of 15 mm and a depth of 3 mm, in the center of a stainless steel disk having a diameter of 30 mm and a height of 5 mm.

The sample is placed, without compacting, into the sample-accommodating recess 10*a*, using a weighing spoon. Thereafter, the surface of the sample is flattened and evened out using a knife edge, and in that state, the measurement cell is fixed to a specified position on a sample stand, and a measurement is carried out.

Upon scanning in this surface analysis at intervals of 0.1 eV from low to high excitation energy of monochromatic light, photon emission starts from a given energy value (eV), and this energy threshold is taken as the work function (eV).

Figure 2:
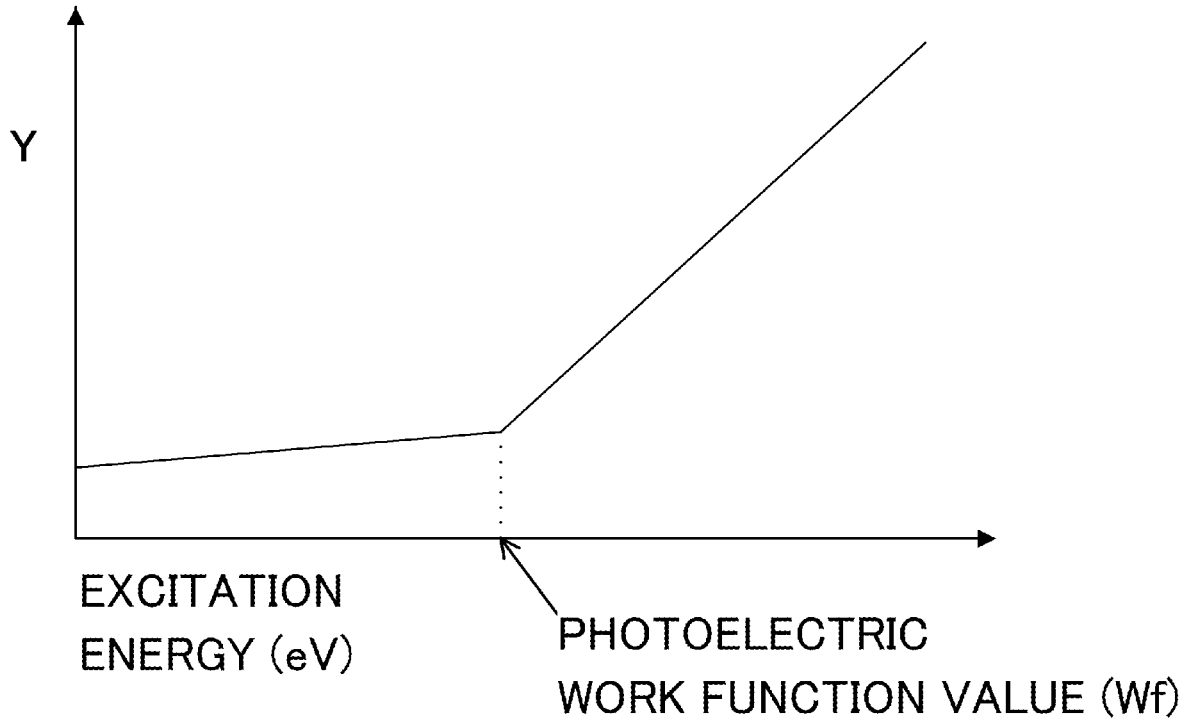
FIG. 2 is an example of a work function measurement curve.

FIG. 2 illustrates an example of a measurement curve of a work function obtained through measurement under the above conditions.

In FIG. 2 the horizontal axis represents excitation energy (eV), the vertical axis represents a value (normalized photon yield) Y being the 0.5 power of the number of emitted photoelectrons. Ordinarily, once an excitation energy value exceeds a certain threshold value, emission of photoelectrons i.e. the normalized photon yield increases sharply, and the work function measurement curve rises rapidly. This rising point is defined as a photoelectric work function value (Wf). This photoelectric work function value (Wf) is taken as the work function of the toner.

<Method for Measuring the Weight-Average Molecular Weight (Mw) of the Polymer A>

The weight-average molecular weight (Mw) of a tetrahydrofuran (THF)-soluble fraction of the polymer A is measured by gel permeation chromatography (GPC), as follows.

Firstly, a sample is dissolved in tetrahydrofuran (THF) for 24 hours at room temperature. The obtained solution is then filtered through a solvent-resistant membrane filter "MYSYORI DISC" (by Tosoh Corporation) having a pore diameter of 0.2 μm, to obtain a sample solution. The sample solution is adjusted so that the concentration of THF-soluble components is 0.8 mass %. A measurement is performed under the conditions below, using the sample solution.

Device: HLC8120 GPC (detector: RI) (by Tosoh Corporation)

Column: seven consecutive columns Shodex KF-801, 802, 803, 804, 805, 806 and 807 (by Showa Denko K.K.)

Eluent: tetrahydrofuran (THF)

Flow rate: 1.0 mL/min

Oven temperature: 40.0° C.

Sample injection amount: 0.10 mL

To calculate the molecular weight of the sample there was used a molecular weight calibration curve created using a standard polystyrene resin (product name "TSK STANDARD POLYSTYRENE F-850, F-450, F-288, F-128, F-80, F-40, F-20, F-10, F-4, F-2, F-1, A-5000, A-2500, A-1000 or A-500", by Tosoh Corporation.

<Method for Measuring the Melting Point>

The melting point of the polymer A and the release agent are measured under the conditions below, using DSC Q1000 (by TA Instruments Inc.).

Ramp rate: 10° C./min

Measurement start temperature: 20° C.

Measurement end temperature: 180° C.

The melting points of indium and zinc are used for temperature correction in the detection unit of the device, and the heat of fusion of indium is used for correcting the amount of heat.

Specifically, 5 mg of a sample are precisely weighed, are placed in an aluminum pan, and differential scanning calorimetry is performed. An empty pan made of silver is used as a reference.

The peak temperature of a maximum endothermic peak in a first temperature rise process is taken as the melting point (° C.).

In a case where there is a plurality of maximum endothermic peaks, the largest peak is taken as the endothermic amount.

EXAMPLES

The present invention will be explained in detail below on the basis of examples and comparative examples, but the invention is not meant to be limited thereto in any way. Unless otherwise noted, the language "part" in the formulations below denotes parts by mass.

<Preparation of a Monomer Having a Urethane Group>

Herein 50.0 parts of methanol were charged into a reaction vessel. Thereafter, 5.0 parts of KarenzMOI (2-isocyanatoethyl methacrylate by Showa Denko KK) were dropped under stirring, at 40° C. Once dropping was over, the whole was stirred for 2 hours while the temperature was maintained at 40° C. Thereafter, unreacted methanol was removed in an evaporator, to thereby prepare a monomer having a urethane group.

<Preparation of a Monomer Having a Urea Group>

Herein 50.0 parts of dibutyl amine were charged into a reaction vessel. Thereafter, 5.0 parts of KarenzMOI (2-isocyanatoethyl methacrylate) were dropped at room temperature, under stirring. Once dripping was over, the whole was stirred for 2 hours. Thereafter, unreacted dibutyl amine was removed in an evaporator, to thereby prepare a monomer having a urea group.

<Preparation of Polymer A0>

The materials below were charged, under a nitrogen atmosphere, into a reaction vessel equipped with a reflux condenser, a stirrer, a thermometer and a nitrogen introduction pipe.

| | |
|---|---|
| Toluene | 100.0 parts |
| Monomer composition (the monomer composition is a mixture of the behenyl acrylate, methacrylonitrile and styrene below in the proportions given below) | 100.0 parts |
| Behenyl acrylate (first polymerizable monomer) | 67.0 parts (28.9 mol %) |
| Methacrylonitrile (second polymerizable monomer) | 22.0 parts (53.8 mol %) |
| Styrene (third polymerizable monomer) | 11.0 parts (17.3 mol %) |
| t-butyl peroxypivalate (polymerization initiator: Perbutyl PV, by NOF Corporation) | 0.5 parts |

A polymerization reaction was carried out for 12 hours, through heating at 70° C. while the interior of reaction vessel was stirred at 200 rpm, to obtain a solution in which a polymer of the monomer composition was dissolved in toluene. Subsequently, the temperature of the solution was lowered to 25° C. and then the solution was added to 1000.0 parts of methanol, while under stirring, to elicit precipitation of a methanol-insoluble fraction. The obtained methanol-insoluble fraction was separated by filtration, was further washed with methanol, and was vacuum-dried at 40° C. for 24 hours, to yield a polymer A0. The weight-average molecular weight (Mw) of the polymer A0 was 68,400, the acid value was 0.0 mgKOH/g, and the melting point was 62° C.

The polymer A0 was analyzed by NMR; the results yielded 28.9 mol % of a monomer unit derived from behenyl acrylate, 53.8 mol % of a monomer unit derived from methacrylonitrile and 17.3 mol % of a monomer unit derived from styrene.

<Preparation of an Amorphous Resin>

The following starting materials were charged into a heat-dried two-necked flask while under introduction of nitrogen.

| | |
|---|---|
| Polyoxypropylene (2.2)-2,2-bis(4-hydroxyphenyl)propane | 30.0 parts |
| Polyoxyethylene (2.2)-2,2-bis(4-hydroxyphenyl)propane | 33.0 parts |
| Terephthalic acid | 21.0 parts |
| Dodecenyl succinic acid | 15.0 parts |
| Dibutyltin oxide | 0.1 parts |

The interior of the system was purged with nitrogen as a result of a reduced pressure operation, and thereafter stirring was performed at 215° C. for 5 hours. Thereafter, the temperature was gradually raised to 230° C., under reduced pressure and while stirring was continued, and that temperature was maintained for a further 2 hours. Once a viscous state was reached, air cooling was carried out to stop the reaction; an amorphous resin, which was an amorphous polyester, was synthesized as a result. The number-average molecular weight (Mn) of the amorphous resin was 5,200, the weight-average molecular weight (Mw) was 23,000 and the glass transition temperature (Tg) was 55° C.

<Production Example of Toner 1>

[Production of Toner by Suspension Polymerization]

(Production of Toner Particle 1)

A mixture was prepared that contained:

| | |
|---|---|
| Monomer composition (The monomer composition is a mixture of behenyl acrylate, methacrylonitrile, styrene and a macromonomer set out below, in the proportions given below) | 100.0 parts |
| Behenyl acrylate (first polymerizable monomer) | 66.8 parts (28.87 mol %) |
| Methacrylonitrile (second polymerizable monomer) | 21.9 parts (53.79 mol %) |
| Styrene | 11.0 parts (17.33 mol %) |
| Polymethyl methacrylate having a methacryloyl group at an end (macromonomer, AA-6 by Toagosei Co., Ltd., Mn: 6,000) | 0.3 parts ($8.2 \times 10^{-3}$ mol %) |
| C.I. Pigment Blue 15:3 | 6.5 parts |
| Charge control resin (styrene-acrylic acid-based resin containing a quaternary ammonium salt, "FCA-201-PS" by Fujikura Kasei Co., Ltd.) | 0.7 parts |
| Release agent (product name: HNP-51, melting point 78° C., by Nippon Seiro Co., Ltd.) | 20.0 parts |
| Toluene | 100.0 parts |

The resulting mixture was placed in an attritor (by Nippon Coke & Engineering. Co., Ltd.), and was dispersed at 200 rpm for 2 hours using zirconia beads having a diameter of 5 mm, to obtain a starting material dispersion.

Meanwhile, an aqueous solution resulting from dissolving 6.2 parts of sodium hydroxide (alkali metal hydroxide) in 50 parts of ion-exchanged water was gradually added, under stirring, to an aqueous solution obtained by dissolving 10.2 parts of magnesium chloride (water-soluble polyvalent metal salt) in 250 parts of ion-exchanged water, at room temperature, to thereby prepare a dispersion of a magnesium hydroxide colloid (sparsely water-soluble metal hydroxide colloid).

The above polymerizable monomer composition was added to the magnesium hydroxide colloid dispersion at room temperature, with stirring. Then 8.0 parts of t-butyl peroxypivalate (by NOF Corporation: Perbutyl PV) were added as a polymerization initiator, and thereafter the whole was dispersed by high-speed shear stirring for 10 minutes at a rotational speed of 15,000 rpm, using an inline-type emulsification disperser (product name: Milder, by Pacific Machinery & Engineering Co., Ltd.), to elicit formation of droplets of the polymerizable monomer composition.

The obtained granulated liquid was transferred to a reaction vessel equipped with a reflux condenser, a stirrer, a thermometer, and a nitrogen introduction pipe, and the temperature was raised to 70° C. while under stirring at 150 rpm in a nitrogen atmosphere. A polymerization reaction was conducted for 10 hours at 150 rpm while the temperature of 70° C. was held. Thereafter, the reflux condenser was removed from the reaction vessel, the temperature of the reaction solution was raised to 95° C., and subsequently toluene was removed through stirring at 150 rpm for 5 hours, while maintaining the temperature of 95° C., to yield a toner particle dispersion.

Sulfuric acid was dropped at room temperature while under stirring of the obtained toner particle dispersion, to perform acid washing until the pH dropped to 6.5 or below. Filtration separation was performed next, and 500 parts of ion-exchanged water were added to the obtained solids, to elicit slurry formation once again, and a water washing treatment (washing, filtration and dewatering) was repeated several times. Filtration separation was performed next, the obtained solids were charged into the container of a drier and were dried for 24 hours at 40° C., to yield Toner particle 1 containing a polymer A1 of the monomer composition.

Then polymer A1' was obtained in the same way as in the production method of Toner particle 1, but herein without using C.I. Pigment Blue 15:3, the charge control resin or the release agent.

The polymer A1' had a weight-average molecular weight (Mw) of 57,000, and a melting point of 62° C.

An NMR analysis of the polymer A1 yielded 28.87 mol % of a monomer unit derived from behenyl acrylate, 53.79 mol % of a monomer unit derived from methacrylonitrile, 17.33 mol % of a monomer unit derived from styrene, and $8.2 \times 10^{-3}$ mol % of macromonomer.

Polymer A1 and polymer A1' were produced in the same way, and accordingly it was deemed that polymer A1 and polymer A1' had identical physical properties.

(Preparation of Toner 1)

Toner particle 1 was subjected to external addition. Herein 0.7 parts of silica fine particles 1 (silica fine particles in which the number-average particle diameter of primary particles having undergone a hydrophobization treatment with an amino-modified silicone oil was 10 nm) and 1.0 part of silica fine particles 2 (silica fine particles in which the number-average particle diameter of primary particles having undergone a hydrophobization treatment with an amino-modified silicone oil was 55 nm) were dry-mixed for 5 minutes with 100.0 parts of Toner particle 1, in a Henschel mixer (Nippon Coke & Engineering. Co., Ltd.), to yield Toner 1. Table 2 illustrates the physical properties of the obtained Toner 1.

<Production Example of Toners 2 to 27>

Toner particles 2 to 27 were produced in the same way as in production example of Toner 1, but herein the types and addition amounts of the polymerizable monomer, macromonomer and charge control agent or charge control resin that were used were modified as given in Table 1.

In the production example of Toner 25 there was used a macromonomer (AK-32 by Toagosei Co., Ltd., Mn: 20,000) having a main skeleton of dimethylsiloxane and a methacryloyl group at an end.

The same external addition as in the production example of Toner 1 was further carried out, to obtain Toners 2 to 27. Table 2 illustrates the physical properties of Toners 2 to 27.

<Production Example of Toner 28>

A mixture was prepared that contained:

| | |
|---|---|
| Monomer composition (The monomer composition is a mixture of behenyl acrylate, methacrylonitrile, styrene and the macromonomer set out below, in the proportions given below) | 100.0 parts |
| Behenyl acrylate (first polymerizable monomer) | 66.8 parts (28.87 mol %) |
| Methacrylonitrile (second polymerizable monomer) | 21.9 parts (53.79 mol %) |
| Styrene | 11.0 parts (17.33 mol %) |
| Polymethyl methacrylate having a methacryloyl group at an end (macromonomer, AA-6 by Toagosei Co., Ltd., Mn: 6,000) | 0.3 parts ($8.2 \times 10^{-3}$ mol %) |

-continued

| | |
|---|---|
| C.I. Pigment Blue 15:3 | 6.5 parts |
| Charge control resin (styrene-acrylic acid-based resin containing a quaternary ammonium salt, "FCA-201-PS" by Fujikura Kasei Co., Ltd.) | 0.7 parts |
| Release agent (product name: HNP-51, melting point 78° C., by Nippon Seiro Co., Ltd.) | 20.0 parts |
| Toluene | 100.0 parts |

The resulting mixture was placed in an attritor (by Nippon Coke & Engineering. Co., Ltd.), and was dispersed at 200 rpm for 2 hours using zirconia beads having a diameter of 5 mm, to obtain a starting material dispersion for a core.

Meanwhile, 5 parts of methyl methacrylate (calculated Tg of the obtained polymer=105° C.), 100 parts of water and 0.01 parts of a charge control agent (BONTRON E-84, by Orient Chemical Industries Co.) were subjected to a fine dispersion treatment using an ultrasonic emulsifying machine, to obtain an aqueous dispersion of a polymerizable monomer for a shell.

Also, a dispersion of a colloid of magnesium hydroxide (colloid of a sparsely water-soluble metal hydroxide) was prepared by gradually adding, under stirring, an aqueous solution resulting from dissolving 6.9 parts of sodium hydroxide (alkali metal hydroxide) in 50 parts of ion-exchanged water, to an aqueous solution obtained by dissolving 9.8 parts of magnesium chloride (water-soluble polyvalent metal salt) in 250 parts of ion-exchanged water.

The above starting material dispersion for a core was added in the obtained magnesium hydroxide colloid dispersion, and high-shear stirring was performed at rotational speed of 8000 rpm using a TK homomixer, to granulate droplets as a result. The aqueous dispersion containing the granulated monomer mixture was placed in a reactor equipped with a stirring blade, and a polymerization reaction was carried out at 150 rpm for 10 hours while the temperature of 70° C. was maintained.

Thereafter, the aqueous dispersion of the polymerizable monomer for a shell prepared above and 1 part of a 1% aqueous solution of potassium persulfate were added, with the reaction continuing for 5 hours, after which the reaction was stopped, to yield a toner particle dispersion having a core-shell type structure.

Thereafter, Toner 28 was obtained in the same way as in the production example of Toner 1.

<Production Example of Toner 29>

[Production of a Toner by Emulsion Aggregation]

(Preparation of a Polymer Dispersion)

| | |
|---|---|
| Toluene | 300.0 parts |
| Polymer AO | 100.0 parts |

The above materials were weighed and mixed, and dissolved at 90° C.

Separately, 5.0 parts of sodium dodecylbenzene sulfonate and 10.0 parts of sodium laurate were added to 700.0 parts of ion-exchanged water, and the resulting mixture was dissolved through heating at 90° C. Then the above toluene solution and aqueous solution were mixed, with stirring using an ultra-high speed stirring device T. K. Robomix (by Primix Corporation) at 7000 rpm. Further, the resulting mixture was emulsified at a pressure of 200 MPa using a high-pressure impact-type dispersing machine Nanomizer (by Yoshida Kikai Co., Ltd.). Thereafter, toluene was removed using an evaporator, and the concentration was adjusted with ion-exchanged water, to yield a polymer dispersion having a concentration of 20% of polymer fine particles.

The 50% particle size (D50), on a volume distribution basis, of the polymer fine particles was measured using a particle size distribution analyzer of dynamic light scattering type Nanotrac UPA-EX150 (by Nikkiso Co., Ltd.). The result was 0.40 μm.

(Preparation of Release Agent Dispersion 1)

| | |
|---|---|
| Release agent (HNP-51, melting point 78° C., by Nippon Seiro Co., Ltd.) | 100.0 parts |
| Anionic surfactant Neogen RK (by DKS Co. Ltd.) | 5.0 parts |
| Ion-exchanged water | 395.0 parts |

The above materials were weighed, charged into a mixing vessel equipped with a stirrer, were heated to 90° C., and were caused to circulate in CLEARMIX W-MOTION (by M. Technique Co., Ltd.), to carry out a dispersion treatment for 60 minutes. The conditions in the dispersion treatment were as follows.

Rotor outer diameter 3 cm

Clearance 0.3 mm

Rotor rotational speed 19000 r/min

Screen rotational speed 19000 r/min

The dispersion treatment was followed by cooling down to 40° C., under cooling processing conditions that included a rotor rotational speed of 1000 r/min, a screen rotational speed of 0 r/min and a cooling rate of 10° C./min, to yield Release agent dispersion 1 having a concentration of 20% of Release agent fine particles 1.

The 50% particle size (D50), on a volume distribution basis, of Release agent fine particles 1 was measured using a particle size distribution analyzer of dynamic light scattering type Nanotrac UPA-EX150 (by Nikkiso Co., Ltd.). The result was 0.15 μm.

(Preparation of Colorant-dispersed solution 1)

| | |
|---|---|
| Colorant (Cyan pigment by Dainichiseika Color & Chemicals Mfg. Co., Ltd.: C.I. Pigment Blue 15:3) | 50.0 parts |
| Anionic surfactant Neogen RK (by DKS Co. Ltd.) | 7.5 parts |
| Ion-exchanged water | 442.5 parts |

The above materials were weighed, mixed and dissolved, and then dispersed for 1 hour using a high-pressure impact-type dispersing machine Nanomizer (by Yoshida Kikai Co., Ltd.), to yield Colorant-dispersed solution 1 having a concentration of 10% of Colorant fine particles 1 resulting from dispersion of the colorant.

The 50% particle size (D50), on a volume distribution basis, of Colorant fine particles 1 was measured using a particle size distribution analyzer of dynamic light scattering type Nanotrac UPA-EX150 (by Nikkiso Co., Ltd.). The result was 0.20 μm.

(Production of Toner 29)

| | |
|---|---|
| Polymer dispersion | 500.0 parts |
| Release agent dispersion 1 | 50.0 parts |
| Colorant-dispersed solution 1 | 80.0 parts |
| Ion-exchanged water | 160.0 parts |

The above materials were charged into a round stainless steel flask and were mixed. Subsequently, dispersion was carried out at 5000 r/min for 10 minutes using a homogenizer Ultra-Turrax T50 (by IKA-Werke GmbH & CO. KG). Then a 1.0% nitric acid aqueous solution was added, to adjust pH to 3.0, followed by heating in a heating water bath up to 58° C. while under appropriate adjustment of the rotational speed, so that the mixed solution was stirred, using a stirring blade. The volume-average particle diameter of the aggregated particles thus formed was appropriately checked using Coulter Multisizer III; once aggregated particles having a size of 6.0 μm were formed, pH was adjusted to 9.0 using a 5% aqueous solution of sodium hydroxide. This was followed by heating up to 75° C. while under continued stirring. The temperature of 75° C. was held for 1 hour, to elicit fusion of the aggregated particles.

Polymer crystallization was thereafter promoted through cooling down to 50° C. and keeping of that temperature for 3 hours.

This was followed by cooling down to 25° C., filtration, solid-liquid separation, and subsequent washing using ion-exchanged water. After washing was over, drying was performed using a vacuum drier, to obtain Toner particle 29 having a weight-average particle diameter (D4) of 6.07 μm.

Toner particle 29 was subjected to external addition similarly to the production example of Toner 1, to yield Toner 29. Table 2 illustrates the physical properties of the obtained Toner 29.

<Production Example of Toner 30>

[Production of a Toner by Dissolution Suspension]

(Preparation of Fine Particle Dispersion 1)

A reaction vessel having a stirrer and a thermometer set therein was charged with 683.0 parts of water, 11.0 parts of a sodium salt of a sulfate ester of a methacrylic acid-ethylene oxide (EO) adduct (Eleminol RS-30, by Sanyo Chemical Industries, Ltd.), 130.0 parts of styrene, 138.0 parts of methacrylic acid, 184.0 parts of n-butyl acrylate and 1.0 part of ammonium persulfate, with stirring for 15 minutes at 400 rpm, to thereby obtain a white suspension. After heating, the system temperature was raised to 75° C., and the reaction was left to proceed for 5 hours.

Further, 30.0 parts of a 1% aqueous solution of ammonium persulfate was added, with aging at 75° C. for 5 hours, to obtain Fine particle dispersion 1 of a vinyl polymer. The 50% particle size (D50), on a volume distribution basis, of Fine particle dispersion 1 was measured using a particle size distribution analyzer of dynamic light scattering type Nanotrac UPA-EX150 (by Nikkiso Co., Ltd.). The result was 0.15 μm.

(Preparation of Colorant-Dispersed Solution 2)

| | |
|---|---|
| C.I. Pigment Blue 15:3 | 100.0 parts |
| Ethyl acetate | 150.0 parts |
| Glass beads (1 mm) | 200.0 parts |

The above materials were placed into a heat-resistant glass container, were dispersed for 5 hours in a paint shaker, and the glass beads were removed using a nylon mesh, to yield Colorant-dispersed solution 2. The 50% particle size (D50), on a volume distribution basis, of the colorant-dispersed solution was measured using a particle size distribution analyzer of dynamic light scattering type Nanotrac UPA-EX150 (by Nikkiso Co., Ltd.). The result was 0.20 μm.

(Preparation of Release Agent Dispersion 2)

Release agent 20.0 parts (HNP-51, melting point 78° C., by Nippon Seiro Co., Ltd.)

Ethyl acetate 80.0 parts

The above materials were charged into a sealable reaction vessel, and were heated and stirred at 80° C. Next, the interior of the system was cooled to 25° C. over 3 hours while being gently stirred at 50 rpm, to obtain a milky white liquid.

This solution was placed in a heat-resistant container together with 30.0 parts of glass beads having a diameter of 1 mm, was dispersed for 3 hours in a paint shaker (by Toyo Seiki Kogyo Co., Ltd.), and the glass beads were removed using a nylon mesh, to yield Release agent dispersion 2. The 50% particle size (D50), on a volume distribution basis, of Release agent dispersion 2 was measured using a particle size distribution analyzer of dynamic light scattering type Nanotrac UPA-EX150 (by Nikkiso Co., Ltd.). The result was 0.23 μm.

(Preparation of an Oil Phase)

| | |
|---|---|
| Polymer AO | 100.0 parts |
| Ethyl acetate | 85.0 parts |

The above materials were placed in a beaker and were stirred using a Disper (by Primix Corporation) at 3000 rpm for 1 minute.

| | |
|---|---|
| Release agent dispersion 2 (solids 20%) | 50.0 parts |
| Colorant-dispersed solution 2 (solids 40%) | 12.5 parts |
| Ethyl acetate | 5.0 parts |

The above materials were placed in a beaker and were stirred using a Disper (by Primix Corporation) at 6000 rpm for 3 minutes, to prepare an oil phase.

(Preparation of an Aqueous Phase)

| | |
|---|---|
| Fine particle dispersion 1 | 15.0 parts |
| Aqueous solution of sodium dodecyl diphenyl ether disulfonate (ELEMINOL MON7, by Sanyo Chemical Industries, Ltd.). | 30.0 parts |
| Ion-exchanged water | 955.0 parts |

The above materials were placed in a beaker and were stirred using a Disper (by Primix Corporation) at 3000 rpm for 3 minutes, to prepare an aqueous phase.

(Production of Toner 30)

The oil phase was added to the aqueous phase, with dispersion for 10 minutes at rotational speed of 10000 rpm, using TK Homomixer (by Primix Corporation). Thereafter, the solvent was removed over 30 minutes, under a reduced pressure of 50 mmHg, at 30° C. Filtration was performed next, with operations of filtration and redispersion in ion-exchanged water being repeated until the conductivity of the resulting slurry reached 100 μS. The surfactant was thereby removed to yield a filter cake.

Air classification was performed after vacuum-drying of the filter cake, to yield Toner particle 30.

Toner particle 30 was subjected to external addition similarly to the production example of Toner 1, to yield Toner 30. Table 2 illustrates the physical properties of the obtained Toner 30.

<Production Example of Toner 3>

[Production of a Toner by Pulverization]

| | |
|---|---|
| Polymer A0 | 100.0 parts |
| C.I. Pigment Blue 15:3 | 6.5 parts |
| Release agent (HNP-51, melting point 78° C., by Nippon Seiro Co., Ltd.) | 2.0 parts |
| Charge control agent (quaternary ammonium salt, "BONTRON (registered trademark) P-51" by Orient Chemical Industries Co., Ltd.") | 1.5 parts |

The above materials were premixed in an FM mixer (by Nippon Coke & Engineering. Co., Ltd.) and were then melt-kneaded using a twin-screw kneading extruder (Model PCM-30, by Ikegai Corp.).

The obtained kneaded product was cooled, was coarsely pulverized using a hammer mill, and was then pulverized using a mechanical pulverizer (T-250, by Turbo Kogyo Co., Ltd.); the obtained finely pulverized powder was classified using a multi-grade classifier relying on the Coanda effect, to obtain Toner particle 31 having a weight-average particle diameter (D4) of 7.0 μm.

Toner particle 31 was subjected to external addition similarly to the production example of Toner 1, to yield Toner 31. Table 2 illustrates the physical properties of the obtained Toner 31.

<Production Example of Toner 32>

Herein 0.7 parts of silica fine particles 1 (silica fine particles in which the number-average particle diameter of primary particles having undergone a hydrophobization treatment with an amino-modified silicone oil was 10 nm), 1.0 part of silica fine particles 2 (silica fine particles in which the number-average particle diameter of primary particles having undergone a hydrophobization treatment with an amino-modified silicone oil was 55 nm), and 0.5 parts of conductive titanium oxide particles ("EC-100", by Titan Kogyo Ltd.; base: $TiO_2$ particles; coating layer: Sb-doped $SnO_2$ film; number-average particle diameter of primary particles: 0.35 μm), were dry-mixed with 100.0 parts of Toner particle 31, produced in the production example of Toner 31, for 5 minutes in a Henschel mixer (by Nippon Coke & Engineering. Co., Ltd.), to yield Toner 32. Table 2 illustrates the physical properties of the obtained Toner 32.

<Production Example of Toner 33>

[Production of a Toner by Pulverization]

| | |
|---|---|
| Polymer A0 | 100.0 parts |
| C.I. Pigment Blue 15:3 | 6.5 parts |
| Release agent (HNP-51, melting point 78° C., by Nippon Seiro Co., Ltd.) | 2.0 parts |
| Charge control agent (quaternary ammonium salt, "BONTRON (registered trademark) P-51" by Orient Chemical Industries Co., Ltd.") | 1.5 parts |

The above materials were premixed in an FM mixer (by Nippon Coke & Engineering. Co., Ltd.) and were then melt-kneaded using a twin-screw kneading extruder (Model PCM-30, by Ikegai Corp.).

The obtained kneaded product was cooled, was coarsely pulverized using a hammer mill, and was then pulverized using a mechanical pulverizer (T-250, by Turbo Kogyo Co., Ltd.). The obtained finely pulverized powder was classified using a multi-grade classifier relying on the Coanda effect, to obtain toner core particles having a weight-average particle diameter (D4) of 7.0 μm.

Meanwhile 300 mL of ion-exchanged water were placed in a 1 L three-necked flask equipped with a thermometer and a stirring blade, after which the temperature inside the flask was maintained at 30° C. using a water bath. Next, dilute hydrochloric acid was added into the flask, to adjust the pH of the aqueous medium in the flask to pH 4. After pH adjustment, 2 mL of an aqueous solution of hexamethylolmelamine initial polymer ("Mirbane (registered trademark) Resin SM-607" by Showa Denko K.K., solids concentration 80 mass %), as a starting material of a shell layer were added into the flask. Next, the contents of the flask were stirred, and the shell layer starting material was dissolved in the aqueous medium, to obtain an aqueous solution of the shell layer starting material.

Then 300 g of the above toner core particles were added to the three-necked flask that held the aqueous solution, and the contents of the flask were stirred at a speed of 200 rpm for 1 hour. Next, 300 mL of ion-exchanged water were added, and the temperature inside the flask was raised to 70° C. at a rate of 1° C./minute while under stirring at 100 rpm. After warming, the contents of the flask were continuously stirred for 2 hours at 100 rpm and at 70° C. Sodium hydroxide was added thereafter to adjust the pH of the contents of the flask to pH 7. Next, the content of the flask was cooled down to normal temperature, to obtain a dispersion containing toner base particles.

Wet cake-like toner base particles were filtered out, using a Buchner funnel, from the dispersion containing the toner base particles. The wet cake-like toner base particles were dispersed in ion-exchanged water, to wash the toner base particles. Next, the toner base particles were dried by hot-air drying, to obtain Toner particle 33. Toner particle 33 was subjected to external addition similarly to the production example of Toner 1, to yield Toner 33. Table 2 illustrates the physical properties of the obtained Toner 33.

<Production Example of Toners 34 to 36>

(Preparation of an Amorphous Resin Dispersion)

| | |
|---|---|
| Toluene | 300.0 parts |
| Amorphous resin | 100.0 parts |

The above materials were weighed/mixed, and dissolved at 90° C.

Separately, 5.0 parts of sodium dodecylbenzene sulfonate and 10.0 parts of sodium laurate were added to 700.0 parts of ion-exchanged water, and the resulting mixture was dissolved through heating at 90° C.

Then, the above toluene solution and aqueous solution were mixed, and were stirred using an ultra-high speed stirring device T. K. Robomix (by Primix Corporation) at 7000 rpm.

Further, the mixture was emulsified at a pressure of 200 MPa using a high-pressure impact-type dispersing machine Nanomizer (by Yoshida Kikai Co., Ltd.). Thereafter, toluene was removed using an evaporator, and concentration was adjusted with ion-exchanged water, to obtain an amorphous resin dispersion having a concentration of 20% of amorphous resin fine particles.

The 50% particle size (D50), on a volume distribution basis, of the amorphous resin fine particles was measured using a particle size distribution analyzer of dynamic light scattering type Nanotrac UPA-EX150 (by Nikkiso Co., Ltd.). The result was 0.38 μm.

(Production of Toners 34 to 36)

Toner particles 34 to 36 were obtained in the same way as in production example of Toner 29, but herein the amount of dispersion was modified as given in Table 4.

Further, Toner particles 34 to 36 were subjected to external addition in the same way as in of the production example of Toner 29, to yield Toners 34 to 36. Table 2 illustrates the physical properties of Toners 34 to 36.

<Production Example of Toners 37 to 43>

Toner particles 37 to 43 were produced in the same way as in production example of Toner 1, but herein the types and addition amounts of the polymerizable monomer, macromonomer and charge control agent or charge control resin that were used were modified as given in Table 1.

Further, Toner particles 37 to 43 were subjected to external addition in the same way as in of the production example of Toner 1, to yield Toners 37 to 43. Table 2 illustrates the physical properties of Toners 37 to 43.

Example 1

Toner 1 was evaluated as follows.

<1> Evaluation of Low-Temperature Fixability

An unfixed image of an image pattern having nine 10 mm×10 mm square images uniformly distributed on whole transfer paper was outputted using a non-magnetic single-component developing system printer modified to operate even upon removal of a fixing unit and having mounted thereon a commercially available positive-charging toner.

The transfer paper used was Fox River Bond (90 g/m$^2$), and the toner laid-on level on the transfer paper was set to 0.80 mg/cm$^2$. The toner was allowed to stand for 48 hours in a normal-temperature/normal-humidity (N/N) environment (23° C.; 60% RH) prior to paper feeding.

A fixing unit model LBP-7700C was removed, and an external fixing unit was used so as to operate also outside the laser beam printer.

The unfixed image was passed through the external fixing unit under conditions where the fixation temperature was raised from a temperature of 100° C., in increments of 10° C., and with process speed set to 240 mm/s.

The resulting fixed image having passed through the external fixing unit was rubbed at a load of 50 g/cm$^2$ using lens-cleaning paper (Lenz Cleaning Paper "Dasper®" by Ozu Paper Co. Ltd). Low-temperature fixability was evaluated on the basis of a fixing onset temperature, defined as the temperature at which the rate of decrease of density with respect to that prior to rubbing became 20% or less. The evaluation results are given in Table 5.

[Evaluation Criteria]

A: fixing onset temperature 100° C.

B: fixing onset temperature 110° C.

C: fixing onset temperature 120° C.

D: fixing onset temperature 130° C.

<2> Evaluation of Heat-Resistant Storability

Heat-resistant storability was evaluated in order to evaluate stability at the time of storage.

Herein 6 g of Toner 1 were placed in a 100 mL cup made of polypropylene, and the cup was allowed to stand for 10 days in an environment at a temperature of 50° C. and humidity of 20%. The degree of agglomeration of the toner was measured as described below, and was evaluated in accordance with the criteria below.

As the measuring device there was used a digital-display vibrometer "Digivibro MODEL 1332A" (by Showa Sokki Corporation) connected to a side of the vibrating table of a "Powder Tester" (by Hosokawa Micron Corporation).

The following were stacked sequentially from bottom to top, on the vibrating table of the Powder Tester: a sieve with a mesh opening of 38 μm (400 mesh), a sieve with a mesh opening of 75 m (200 mesh) and a sieve with a mesh opening of 150 μm (100 mesh). The measurement was carried out in a 23° C. and 60% RH environment, as follows.

(1) The vibrational amplitude of the vibrating table was adjusted beforehand so that the displacement in a digital-display vibrometer took on a value of 0.60 mm (peak-to-peak).

(2) The toner having been allowed to stand for 10 days was then left to stand to stand beforehand for 24 hours in an environment at 23° C. and 60% RH. Then 5 g of the toner were weighed and gently placed on the 150 μm-mesh opening sieve at the uppermost stage.

(3) The sieves were caused to vibrate for 15 seconds, after which the mass of the toner remaining on each sieve was measured, and the degree of agglomeration was calculated based on the expression below. The evaluation results are given in Table 5.

Degree of agglomeration (%)={(sample mass (g) on sieve with mesh opening 150 μm)/(5 (g)}×100+{(sample mass (g) on sieve with mesh opening 75 μm)/5 (g)}×100×0.6+{(sample mass (g) on sieve with mesh opening 38 μm)/5 (g)}×100×0.2

The evaluation criteria are as follows.

A: degree of agglomeration lower than 20%

B: degree of agglomeration not lower than 20% but lower than 25%

C: degree of agglomeration not lower than 25% but lower than 30%

D: degree of agglomeration from 30% or higher

<3> Evaluation of Charging Performance (Fogging)

The toner charging performance was evaluated on the basis of fogging.

The obtained Toner 1 was filled into a commercially available printer of non-magnetic single-component developing type (product name: MFC-9840-CDW, by Brother Industries, Ltd.), after which printing paper was set in the printer.

The printer was then allowed to stand for 3 days in a normal-temperature/normal-humidity (N/N) environment (23° C., 60% RH) or in a high-temperature/high-humidity (H/H) environment (32.5° C. and 80% RH). Thereafter, one image having a white background was printed out in each environment. The obtained images were measured for reflectance using a reflection densitometer (Reflectometer model TC-6DS, by Tokyo Denshoku Co., Ltd.). A green filter was used as a filter in the measurements. Then fogging, defined herein as Dr-Ds between a worst value Ds (%) of white background reflectance and the reflectance Dr (%) of the transfer material prior to image formation, was evaluated in accordance with the following criteria. The evaluation results are given in Table 5.

A: fogging lower than 1.0%

B: fogging not lower than 1.0% but lower than 3.0%

C: fogging not lower than 3.0% but lower than 5.0%

D: fogging of 5.0% or higher

<4> Evaluation of Durability

The obtained Toner 1 was filled into a commercially available printer of non-magnetic single-component developing type (product name: MFC-9840-CDW, by Brother Industries, Ltd.), after which printing paper was set in the printer.

Then an image having a print percentage of 1% was outputted continuously in a 23° C., 60% RH environment.

A solid image and a halftone image were outputted every time 1,000 prints were outputted, and the presence or absence of vertical streaks, so-called development streaks, resulting from fusion of toner onto a regulating member was visually checked.

There were finally outputted 20,000 prints of the image. The evaluation results are given in Table 5.

[Evaluation Criteria]

A: No occurrence even at 20,000 prints

B: Occurrence more than 19,000 prints but up to 20,000 prints

C: Occurrence more than 17,000 prints but up to 19,000 prints

D: Occurrence up to 17,000 prints

Examples 2 to 36

Toners 2 to 36 were evaluated in the same way as in Example 1. Results are given in Table 5.

Examples 37 to 39

The following evaluation was carried out also on Toners 31 to 33, in addition to the evaluations illustrated in Example 1.

Toners 31 to 33 obtained above were filled into a commercially available multifunction printer (product name: TASKalfa 250ci, by KYOCERA Document Solutions Inc.), and printing paper was set in the printer.

The printer was allowed to stand for 3 days in a normal-temperature/normal-humidity (N/N) environment (23° C., 60% RH), or in a low-temperature/low-humidity (L/L) environment (15° C., 10% RH), and thereafter one image having a white background was printed out in each environment.

The obtained images were measured for reflectance using a reflection densitometer (Reflectometer model TC-6DS, by Tokyo Denshoku Co., Ltd.). A green filter was used as a filter in the measurements. Then fogging, defined herein as Dr-Ds between a worst value Ds (%) of white background reflectance and the reflectance Dr (%) of the transfer material prior to image formation, was evaluated in accordance with the following criteria. The evaluation results are given in Table 6.

A: fogging lower than 1.0%

B: fogging not lower than 1.0% but lower than 3.0%

C: fogging not lower than 3.0% but lower than 5.0%

D: fogging of 5.0% or higher

Comparative Examples 1 to 7

Toners 37 to 43 were evaluated in the same way as in Example 1. Results are given in Table 5.

The abbreviations in the tables are as follows.

BEA: Behenyl acrylate

BEMA: Behenyl methacrylate

SA: Stearyl acrylate

MYA: Myricyl acrylate

OA: Octacosyl acrylate

HA: Hexadecyl acrylate

MN: Methacrylonitrile

AN: Acrylonitrile

HPMA: 2-Hydroxypropyl methacrylate

AM: Acrylamide

UT: Monomer having a urethane group

UR: Monomer having a urea group

AA: Acrylic acid

VA: Vinyl acetate

MA: Methyl acrylate

St: Styrene

MM: Methyl methacrylate

AA-6: Macromonomer "AA-6" by Toa Gosei Co., Ltd.

AK-32: Macromonomer "AK-32" by Toa Gosei Co., Ltd.

In the charge control agent/resin in Table 1,

"1" represents "FCA-201-PS" by Fujikura Kasei Co., Ltd., and

"2" represents "BONTRON (registered trademark) P-51" by Orient Chemical Industries, Co., Ltd.

TABLE 1

| Toner | Polymer A | | | | | | | | | |
|---|---|---|---|---|---|---|---|---|---|---|
| | First polymerizable monomer | | Second polymerizable monomer | | Third polymerizable monomer | | Fourth polymerizable monomer (macromonomer) | | Charge control agent/resin | |
| No. | Type | Parts | Type | Parts | Type | Parts | Type | Parts | Type | Parts |
| 1 | BEA | 66.8 | MN | 21.9 | ST | 11.0 | AA-6 | 0.3 | 1 | 0.7 |
| 2 | BEA | 39.9 | MN | 39.9 | ST | 19.9 | AA-6 | 0.3 | 1 | 0.7 |
| 3 | BEA | 88.7 | MN | 11.0 | — | — | AA-6 | 0.3 | 1 | 0.7 |
| 4 | BEA | 60.8 | MN | 9.0 | ST | 29.9 | AA-6 | 0.3 | 1 | 0.7 |
| 5 | BEA | 39.9 | MN | 59.8 | — | — | AA-6 | 0.3 | 1 | 0.7 |
| 6 | BEA | 34.0 | MN | 11.0 | ST | 55.0 | AA-6 | 0.1 | 1 | 0.7 |
| 7 | BEA | 67.0 | AN | 22.0 | ST | 11.0 | AA-6 | 0.01 | 1 | 0.7 |
| 8 | BEA | 49.8 | HPMA | 39.8 | ST | 10.0 | AA-6 | 0.5 | 1 | 0.7 |
| 9 | BEA | 59.6 | VA | 29.8 | ST | 9.9 | AA-6 | 0.7 | 1 | 0.7 |
| 10 | BEA | 59.5 | MA | 29.7 | ST | 9.9 | AA-6 | 0.9 | 1 | 0.7 |
| 11 | BEA | 64.4 | AM | 24.8 | ST | 9.9 | AA-6 | 1.0 | 1 | 0.7 |
| 12 | BEA | 60.8 | AA | 9.0 | MM | 29.9 | AA-6 | 0.3 | 1 | 0.7 |
| 13 | SA | 66.8 | MN | 21.9 | ST | 11.0 | AA-6 | 0.3 | 1 | 0.7 |
| 14 | MYA | 66.8 | MN | 21.9 | ST | 11.0 | AA-6 | 0.3 | 1 | 0.7 |
| 15 | OA | 66.8 | MN | 21.9 | ST | 11.0 | AA-6 | 0.3 | 1 | 0.7 |
| 16 | BEA | 62.8 | MN | 7.0 | ST | 22.9 | AA-6 | 0.3 | 1 | 0.7 |
| | | | AA | 7.0 | | | | | | |
| 17 | BEA | 62.8 | MN | 15.0 | ST | 15.0 | AA-6 | 0.3 | 1 | 0.7 |
| | | | AA | 7.0 | | | | | | |
| 18 | BEA | 46.9 | MN | 21.9 | ST | 11.0 | AA-6 | 0.3 | 1 | 0.7 |
| | SA | 19.9 | | | | | | | | |

TABLE 1-continued

| Toner | Polymer A | | | | | | | | | |
|---|---|---|---|---|---|---|---|---|---|---|
| | First polymerizable monomer | | Second polymerizable monomer | | Third polymerizable monomer | | Fourth polymerizable monomer (macromonomer) | | Charge control agent/resin | |
| No. | Type | Parts | Type | Parts | Type | Parts | Type | Parts | Type | Parts |
| 19 | BEA | 39.9 | AN | 27.4 | ST | 29.9 | AA-6 | 0.3 | 1 | 0.7 |
| | | | UT | 2.5 | | | | | | |
| 20 | BEA | 39.9 | AN | 27.4 | ST | 29.9 | AA-6 | 0.3 | 1 | 0.7 |
| | | | UR | 2.5 | | | | | | |
| 21 | BEA | 32.9 | MN | 21.9 | ST | 11.0 | AA-6 | 0.3 | 1 | 0.7 |
| | BEMA | 33.9 | | | | | | | | |
| 22 | BEA | 24.9 | VA | 74.8 | — | — | AA-6 | 0.3 | 1 | 0.7 |
| 23 | BEA | 66.8 | MN | 21.9 | ST | 11.0 | AA-6 | 0.3 | — | — |
| 24 | BEA | 66.8 | MN | 21.9 | ST | 11.0 | AA-6 | 0.3 | 1 | 2.0 |
| 25 | BEA | 66.7 | MN | 21.9 | ST | 11.0 | AK-32 | 0.5 | 1 | 0.7 |
| 26 | BEA | 66.2 | MN | 21.7 | ST | 10.9 | AA-6 | 1.2 | 1 | 0.7 |
| 27 | BEA | 67.0 | MN | 22.0 | ST | 11.0 | — | — | 1 | 0.7 |
| 28 | BEA | 66.8 | MN | 21.9 | ST | 11.0 | AA-6 | 0.3 | 1 | 0.7 |
| 29 | BEA | 67.0 | MN | 22.0 | ST | 11.0 | — | — | 1 | 0.7 |
| 30 | BEA | 67.0 | MN | 22.0 | ST | 11.0 | — | — | 1 | 0.7 |
| 31 | BEA | 67.0 | MN | 22.0 | ST | 11.0 | — | — | 2 | 1.5 |
| 32 | BEA | 67.0 | MN | 22.0 | ST | 11.0 | — | — | 2 | 1.5 |
| 33 | BEA | 67.0 | MN | 22.0 | ST | 11.0 | — | — | 2 | 1.5 |
| 34 | BEA | 67.0 | MN | 22.0 | ST | 11.0 | — | — | 1 | 0.7 |
| 35 | BEA | 67.0 | MN | 22.0 | ST | 11.0 | — | — | 1 | 0.7 |
| 36 | BEA | 67.0 | MN | 22.0 | ST | 11.0 | — | — | 1 | 0.7 |
| 37 | BEA | 66.6 | AA | 4.8 | MM | 28.6 | — | — | 1 | 0.7 |
| 38 | BEA | 20.0 | MN | 53.0 | ST | 27.0 | — | — | 1 | 0.7 |
| 39 | BEA | 90.0 | MN | 10.0 | — | — | — | — | 1 | 0.7 |
| 40 | BEA | 61.0 | MN | 7.0 | ST | 32.0 | — | — | 1 | 0.7 |
| 41 | BEA | 20.0 | MN | 80.0 | — | — | — | — | 1 | 0.7 |
| 42 | HA | 61.0 | MN | 26.0 | ST | 13.0 | — | — | 1 | 0.7 |
| 43 | BEA | 60.0 | — | — | MM | 29.0 | — | — | 1 | 0.7 |
| | | | | | ST | 11.0 | | | | |

TABLE 2

| Toner No. | Polymer A | | | | | | | | | | | | | |
|---|---|---|---|---|---|---|---|---|---|---|---|---|---|---|
| | First monomer unit | | Second monomer unit | | Third monomer unit | | Fourth monomer unit | | | | | | | |
| | Type | Molar ratio mol % | Type | Molar ratio mol % | Type | Molar ratio mol % | Type | Molar ratio mol % | $SP_{21} - SP_{11}$ | $SP_{22} - SP_{12}$ | Weight-average molecular weight Mw | Melting point ° C. | Work function eV | X |
| 1 | BEA | 28.87 | MN | 53.79 | ST | 17.33 | AA-6 | $8.2 \times 10^{-3}$ | 7.71 | 4.28 | 57000 | 62 | 5.3 | 100 |
| 2 | BEA | 11.76 | MN | 66.74 | ST | 21.50 | AA-6 | $5.6 \times 10^{-3}$ | 7.71 | 4.28 | 55200 | 55 | 5.3 | 100 |
| 3 | BEA | 58.77 | MN | 41.21 | — | — | AA-6 | $1.3 \times 10^{-2}$ | 7.71 | 4.28 | 55800 | 62 | 5.3 | 100 |
| 4 | BEA | 27.51 | MN | 23.03 | ST | 49.45 | AA-6 | $8.6 \times 10^{-3}$ | 7.71 | 4.28 | 54900 | 57 | 5.3 | 100 |
| 5 | BEA | 10.51 | MN | 89.48 | — | — | AA-6 | $5.0 \times 10^{-3}$ | 7.71 | 4.28 | 58800 | 56 | 5.3 | 100 |
| 6 | BEA | 11.43 | MN | 20.98 | ST | 67.59 | AA-6 | $2.1 \times 10^{-3}$ | 7.71 | 4.28 | 54400 | 53 | 5.3 | 100 |
| 7 | BEA | 25.28 | AN | 59.55 | ST | 15.17 | AA-6 | $2.4 \times 10^{-4}$ | 11.19 | 5.05 | 56500 | 62 | 5.3 | 100 |
| 8 | BEA | 26.02 | HPMA | 54.95 | ST | 19.02 | AA-6 | $1.7 \times 10^{-2}$ | 5.87 | 4.36 | 54400 | 59 | 5.3 | 100 |
| 9 | BEA | 26.17 | VA | 57.86 | ST | 15.94 | AA-6 | $1.9 \times 10^{-2}$ | 3.35 | 0.61 | 54600 | 56 | 5.3 | 100 |
| 10 | BEA | 26.17 | MA | 57.86 | ST | 15.94 | AA-6 | $2.5 \times 10^{-2}$ | 3.35 | 0.61 | 55700 | 54 | 5.3 | 100 |
| 11 | BEA | 27.60 | AM | 56.85 | ST | 15.52 | AA-6 | $2.7 \times 10^{-2}$ | 21.01 | 11.43 | 57800 | 59 | 5.3 | 100 |
| 12 | BEA | 27.40 | AA | 21.35 | MM | 51.24 | AA-6 | $8.5 \times 10^{-3}$ | 10.47 | 4.97 | 58100 | 57 | 5.3 | 100 |
| 13 | SA | 32.26 | MN | 51.23 | ST | 16.50 | AA-6 | $7.8 \times 10^{-3}$ | 7.57 | 4.25 | 56400 | 54 | 5.3 | 100 |
| 14 | MYA | 23.87 | MN | 57.58 | ST | 18.55 | AA-6 | $8.8 \times 10^{-3}$ | 7.88 | 4.32 | 52800 | 76 | 5.3 | 100 |
| 15 | OA | 24.95 | MN | 56.76 | ST | 18.28 | AA-6 | $8.7 \times 10^{-3}$ | 7.85 | 4.32 | 54400 | 78 | 5.3 | 100 |
| 16 | BEA | 28.15 | MN | 17.75 | ST | 37.57 | AA-6 | $8.5 \times 10^{-3}$ | 7.71 | 4.28 | 56900 | 58 | 5.3 | 100 |
| | | | AA | 16.52 | | | | | 10.47 | 4.97 | | | | |
| 17 | BEA | 26.26 | MN | 35.47 | ST | 22.85 | AA-6 | $7.9 \times 10^{-3}$ | 7.71 | 4.28 | 53900 | 61 | 5.3 | 100 |
| | | | AA | 15.41 | | | | | 10.47 | 4.97 | | | | |
| 18 | BEA | 19.96 | MN | 53.0 | ST | 17.07 | AA-6 | $8.1 \times 10^{-3}$ | 7.67 | 4.27 | 54800 | 58 | 5.3 | 100 |
| | SA | 9.96 | | | | | | | | | | | | |
| 19 | BEA | 11.36 | AN | 56.04 | ST | 31.15 | AA-6 | $5.4 \times 10^{-3}$ | 11.19 | 5.05 | 54600 | 55 | 5.3 | 100 |
| | | | UT | 1.44 | | | | | 5.54 | 4.21 | | | | |
| 20 | BEA | 11.42 | AN | 56.32 | ST | 31.30 | AA-6 | $5.4 \times 10^{-3}$ | 11.19 | 5.05 | 56400 | 55 | 5.3 | 100 |
| | | | UR | 0.96 | | | | | 3.50 | 3.17 | | | | |

TABLE 2-continued

| | Polymer A | | | | | | | | | | | | | |
|---|---|---|---|---|---|---|---|---|---|---|---|---|---|---|
| | First monomer unit | | Second monomer unit | | Third monomer unit | | Fourth monomer unit | | | | | | | |
| Toner No. | Type | Molar ratio mol % | Type | Molar ratio mol % | Type | Molar ratio mol % | Type | Molar ratio mol % | $SP_{21} - SP_{11}$ | $SP_{22} - SP_{12}$ | Weight-average molecular weight Mw | Melting point ° C. | Work function eV | X |
| 21 | BEA | 14.30 | MN | 54.1 | ST | 17.42 | AA-6 | $8.2 \times 10^{-3}$ | 7.79 | 4.32 | 57400 | 62 | 5.3 | 100 |
| | BEMA | 14.21 | | | | | | | | | | | | |
| 22 | BEA | 7.01 | VA | 92.98 | — | — | AA-6 | $5.3 \times 10^{-3}$ | 3.35 | 0.62 | 55000 | 59 | 5.3 | 100 |
| 23 | BEA | 28.87 | MN | 53.79 | ST | 17.33 | AA-6 | $8.2 \times 10^{-3}$ | 7.71 | 4.28 | 57000 | 62 | 5.4 | 100 |
| 24 | BEA | 28.87 | MN | 53.79 | ST | 17.33 | AA-6 | $8.2 \times 10^{-3}$ | 7.71 | 4.28 | 57000 | 62 | 5.0 | 100 |
| 25 | BEA | 28.88 | MN | 53.79 | ST | 17.33 | AK-32 | $4.1 \times 10^{-3}$ | 7.71 | 4.28 | 57000 | 62 | 5.3 | 100 |
| 26 | BEA | 28.87 | MN | 53.78 | ST | 17.32 | AA-6 | $3.3 \times 10^{-2}$ | 7.71 | 4.28 | 58000 | 62 | 5.3 | 100 |
| 27 | BEA | 28.9 | MN | 53.8 | ST | 17.3 | — | — | 7.71 | 4.28 | 56000 | 62 | 5.3 | 100 |
| 28 | BEA | 28.87 | MN | 53.79 | ST | 17.33 | AA-6 | $8.2 \times 10^{-3}$ | 7.71 | 4.28 | 57000 | 62 | 5.3 | 100 |
| 29 | BEA | 28.9 | MN | 53.8 | ST | 17.3 | — | — | 7.71 | 4.28 | 68400 | 62 | 5.3 | 100 |
| 30 | BEA | 28.9 | MN | 53.8 | ST | 17.3 | — | — | 7.71 | 4.28 | 68400 | 62 | 5.3 | 100 |
| 31 | BEA | 28.9 | MN | 53.8 | ST | 17.3 | — | — | 7.71 | 4.28 | 68400 | 62 | 5.1 | 100 |
| 32 | BEA | 28.9 | MN | 53.8 | ST | 17.3 | — | — | 7.71 | 4.28 | 68400 | 62 | 5.1 | 100 |
| 33 | BEA | 28.9 | MN | 53.8 | ST | 17.3 | — | — | 7.71 | 4.28 | 68400 | 62 | 5.1 | 100 |
| 34 | BEA | 28.9 | MN | 53.8 | ST | 17.3 | — | — | 7.71 | 4.28 | 68400 | 62 | 5.3 | 82 |
| 35 | BEA | 28.9 | MN | 53.8 | ST | 17.3 | — | — | 7.71 | 4.28 | 68400 | 62 | 5.3 | 52 |
| 36 | BEA | 28.9 | MN | 53.8 | ST | 17.3 | — | — | 7.71 | 4.28 | 68400 | 62 | 5.3 | 48 |
| 37 | BEA | 33.2 | AA | 12.6 | MM | 54.2 | — | — | 10.47 | 4.97 | 52700 | 56 | 5.3 | 100 |
| 38 | BEA | 4.8 | MN | 71.7 | ST | 23.5 | — | — | 7.71 | 4.28 | 54500 | 55 | 5.3 | 100 |
| 39 | BEA | 61.3 | MN | 38.7 | — | — | — | — | 7.71 | 4.28 | 55800 | 62 | 5.3 | 100 |
| 40 | BEA | 28.0 | MN | 18.2 | ST | 53.8 | — | — | 7.71 | 4.28 | 52900 | 56 | 5.3 | 100 |
| 41 | BEA | 4.2 | MN | 95.8 | — | — | — | — | 7.71 | 4.28 | 56300 | 55 | 5.3 | 100 |
| 42 | HA | 28.6 | MN | 54.0 | ST | 17.4 | — | — | 7.49 | 4.23 | 52200 | 45 | 5.3 | 100 |
| 43 | BEA | 28.5 | — | — | MM | 52.4 | — | — | — | — | 56500 | 52 | 5.3 | 100 |
| | | | | | ST | 19.1 | | | | | | | | |

The reference symbol X in Table 2 denotes the content (mass %) of the polymer A in the binder resin.

TABLE 3

| | | SP value $(J/cm^3)^{0.5}$ of polymerizable monomer | SP value $(J/cm^3)^{0.5}$ of monomer unit |
|---|---|---|---|
| First polymerizable monomer | Behenyl acrylate | 17.69 | 18.25 |
| | Behenyl methacrylate | 17.61 | 18.10 |
| | Stearyl acrylate | 17.71 | 18.39 |
| | Myricyl acrylate | 17.65 | 18.08 |
| | Octacosyl acrylate | 17.65 | 18.10 |
| | Hexadecyl acrylate | 17.73 | 18.47 |
| Second polymerizable monomer | Acrylonitrile | 22.75 | 29.43 |
| | Methacrylonitrile | 21.97 | 25.96 |
| | Acrylic acid | 22.66 | 28.72 |
| | Methacrylic acid | 21.95 | 25.65 |
| | 2-Hydroxypropyl methacrylate | 22.05 | 24.12 |
| | Vinyl acetate | 18.31 | 21.60 |
| | Methyl acrylate | 18.31 | 21.60 |
| | Acrylamide | 29.13 | 39.25 |
| | Monomer having a urethane group | 21.91 | 23.79 |

TABLE 3-continued

| | | SP value $(J/cm^3)^{0.5}$ of polymerizable monomer | SP value $(J/cm^3)^{0.5}$ of monomer unit |
|---|---|---|---|
| | Monomer having a urea group | 20.86 | 21.74 |
| Third polymerizable monomer | Styrene | 17.94 | 20.11 |
| | Methyl methacrylate | 18.27 | 20.31 |

TABLE 4

| | Polymer dispersion Parts | Amorphous resin dispersion Parts | Release agent dispersion Parts | Colorant dispersion Parts |
|---|---|---|---|---|
| Toner 29 | 500.0 | — | 50.0 | 80.0 |
| Toner 34 | 410.0 | 90.0 | 50.0 | 80.0 |
| Toner 35 | 260.0 | 240.0 | 50.0 | 80.0 |
| Toner 36 | 240.0 | 260.0 | 50.0 | 80.0 |

TABLE 5

| | Toner | | Low temperature fixability | Heat-resistant storability | | Charging performance N/N | | Charging performance H/H | | |
|---|---|---|---|---|---|---|---|---|---|---|
| | No. | | | Rank | Value | Rank | Value | Rank | Value | Durability |
| Example 1 | 1 | A | | A | 15 | A | 0.4 | A | 0.6 | A |
| Example 2 | 2 | C | | C | 27 | C | 3.5 | C | 4.3 | A |
| Example 3 | 3 | A | | A | 16 | A | 0.5 | A | 0.8 | C |

TABLE 5-continued

| | Toner No. | Low temperature fixability | Heat-resistant storability Rank | Heat-resistant storability Value | Charging performance N/N Rank | Charging performance N/N Value | Charging performance H/H Rank | Charging performance H/H Value | Durability |
|---|---|---|---|---|---|---|---|---|---|
| Example 4 | 4 | A | B | 23 | B | 1.6 | B | 2.6 | C |
| Example 5 | 5 | C | B | 22 | B | 1.8 | B | 2.8 | A |
| Example 6 | 6 | C | C | 26 | C | 3.5 | C | 4.3 | C |
| Example 7 | 7 | A | A | 18 | A | 0.5 | A | 0.7 | A |
| Example 8 | 8 | A | B | 22 | B | 1.8 | B | 2.5 | A |
| Example 9 | 9 | A | B | 23 | A | 0.5 | A | 0.8 | A |
| Example 10 | 10 | A | C | 28 | B | 1.7 | B | 2.6 | A |
| Example 11 | 11 | B | B | 23 | B | 1.6 | B | 2.4 | A |
| Example 12 | 12 | A | C | 28 | B | 1.8 | B | 2.3 | C |
| Example 13 | 13 | A | C | 26 | A | 0.4 | A | 0.6 | A |
| Example 14 | 14 | C | A | 18 | A | 0.4 | A | 0.7 | A |
| Example 15 | 15 | C | A | 17 | A | 0.5 | A | 0.8 | A |
| Example 16 | 16 | A | B | 23 | A | 0.4 | A | 0.7 | A |
| Example 17 | 17 | A | A | 17 | A | 0.5 | A | 0.6 | A |
| Example 18 | 18 | A | B | 24 | A | 0.5 | A | 0.8 | A |
| Example 19 | 19 | C | C | 28 | C | 3.5 | C | 4.3 | A |
| Example 20 | 20 | C | C | 27 | C | 3.7 | C | 4.5 | A |
| Example 21 | 21 | A | A | 17 | A | 0.5 | A | 0.7 | A |
| Example 22 | 22 | C | A | 18 | A | 0.6 | A | 0.9 | A |
| Example 23 | 23 | A | A | 18 | B | 2.5 | C | 3.5 | A |
| Example 24 | 24 | A | A | 19 | B | 2.7 | C | 3.8 | A |
| Example 25 | 25 | A | A | 18 | A | 0.4 | B | 2.6 | A |
| Example 26 | 26 | B | A | 17 | A | 0.5 | A | 0.7 | A |
| Example 27 | 27 | A | B | 22 | B | 1.8 | C | 4.3 | A |
| Example 28 | 28 | A | A | 12 | A | 0.3 | A | 0.5 | A |
| Example 29 | 29 | A | A | 18 | A | 0.5 | B | 2.5 | A |
| Example 30 | 30 | A | A | 19 | A | 0.4 | B | 2.6 | A |
| Example 31 | 31 | A | A | 18 | A | 0.5 | B | 2.8 | A |
| Example 32 | 32 | A | A | 19 | A | 0.5 | B | 2.7 | A |
| Example 33 | 33 | A | A | 18 | A | 0.5 | B | 2.4 | A |
| Example 34 | 34 | A | A | 17 | A | 0.5 | B | 2.3 | A |
| Example 35 | 35 | B | A | 17 | B | 1.6 | B | 2.5 | A |
| Example 36 | 36 | C | A | 18 | C | 3.6 | C | 4.3 | A |
| Comparative Example 1 | 37 | A | C | 28 | D | 5.2 | D | 62 | D |
| Comparative Example 2 | 38 | D | C | 29 | D | 5.3 | D | 6.3 | A |
| Comparative Example 3 | 39 | A | A | 18 | D | 5.2 | D | 6.5 | D |
| Comparative Example 4 | 40 | A | C | 26 | D | 5.3 | D | 7.2 | D |
| Comparative Example 5 | 41 | D | C | 28 | D | 5.4 | D | 7.8 | A |
| Comparative Example 6 | 42 | A | D | 30 | D | 5.3 | D | 6.5 | A |
| Comparative Example 7 | 43 | A | D | 31 | D | 5.4 | D | 7.4 | A |

TABLE 6

| | Toner | Fogging N/N Rank | Fogging N/N Value | Fogging L7L Rank | Fogging L7L Value |
|---|---|---|---|---|---|
| Example 37 | Toner 31 | B | 1.7 | C | 3.5 |
| Example 38 | Toner 32 | A | 0.4 | A | 0.9 |
| Example 39 | Toner 33 | B | 1.8 | C | 3.8 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-113075, filed Jun. 13, 2018, and Japanese Patent Application No. 2019-075025, filed Apr. 10, 2019, which are hereby incorporated by reference herein in their entirety.

What is claimed is:

1. A positive-charging toner, comprising a toner particle that contains a binder resin, wherein the binder resin contains a polymer A, the polymer A is a polymer obtained by polymerization of a composition that contains a first polymerizable monomer;

a second polymerizable monomer that is different from the first polymerizable monomer; and a macromonomer that is a polymerizable monomer;

the first polymerizable monomer is at least one selected from the group consisting of (meth)acrylic acid esters having a C18 to C36 alkyl group;

a content of the first polymerizable monomer in the composition is 5.0 mol % to 60.0 mol % with respect to the total number of moles of all polymerizable monomers in the composition;

a content of the second polymerizable monomer in the composition is 20.0 mol % to 95.0 mol % with respect to the total number of moles of all polymerizable monomers in the composition;

assuming that an SP (solubility parameter) value of the first polymerizable monomer is taken as $SP_{12}$ $(J/cm^3)^{0.5}$ and an SP value of the second polymerizable monomer is taken as $SP_{22}$ $(J/cm^3)^{0.5}$, $$0.60 \leq (SP_{22} - SP_{12})\ 15.00 \quad (2)$$

is satisfied; and the work function of the toner is 5.0 eV to 5.4 eV, and wherein the number-average molecular weight of the macromonomer is 1,000 to 20,000;

the macromonomer contains an acryloyl group or a methacryloyl group at a molecular chain end; and a content of the macromonomer in the composition is $1.0\times10^{-4}$ mol % to $3.0\times10^{-1}$ mol % with respect to the total number of moles of all polymerizable monomers in the composition.

2. The positive-charging toner according to claim 1, wherein the content of the second polymerizable monomer in the composition is 40.0 mol % to 95.0 mol % with respect to the total number of moles of all polymerizable monomers in the composition.

3. The positive-charging toner according to claim 1, wherein the content of the polymer A in the binder resin is 50.0 mass % or higher.

4. The positive-charging toner according to claim 1, wherein the first polymerizable monomer is at least one selected from the group consisting of (meth)acrylic acid esters having a C18 to C36 linear alkyl group.

5. The positive-charging toner according to claim 1, wherein the second polymerizable monomer is at least one selected from the group consisting of Formulae (A) and (B) below:

(A)

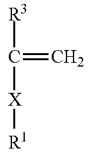

(B)

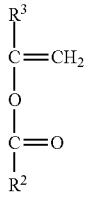

where, X represents a single bond or a C1 to C6 alkylene group;

$R^1$ represents a nitrile group (—CN), an amide group (—C(═O)NHR$^{10}$ (where R$^{10}$ is a hydrogen atom or a C1 to C4 alkyl group)), a hydroxy group, —COOR$^{11}$ (where R$^{11}$ is a C1 to C6 alkyl group or a C1 to C6 hydroxyalkyl group), a urethane group (—NHCOOR$^{12}$ (where R$^{12}$ is a C1 to C4 alkyl group)), a urea group (—NH—C(═O)—N(R$^{13}$)$_2$ (where R$^{13}$ are each independently a hydrogen atom or a C1 to C6 alkyl group)), —COO(CH$_2$)$_2$NHCOOR$^{14}$ (where R$^{14}$ is a C1 to C4 alkyl group); or —COO(CH$_2$)$_2$—NH—C(═O)—N(R$^{15}$)$_2$ (where R$^{15}$ are each independently a hydrogen atom or a C1 to C6 alkyl group); and $R^3$ represent a hydrogen atom or a methyl group:

$R^2$ represents a C1 to C4 alkyl group; and $R^3$ represent a hydrogen atom or a methyl group.

6. The positive-charging toner according to claim 1, wherein the second polymerizable monomer is at least one selected from the group consisting of Formulae (A) and (B) below:

(A)

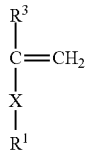

(B)

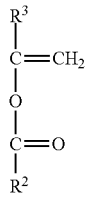

where, X represents a single bond or a C1 to C6 alkylene group;

$R^1$ represents a nitrile group (—C≡N), an amide group (—C(═O)NHR$^{10}$ (where R$^{10}$ is a hydrogen atom or a C1 to C4 alkyl group)), a hydroxy group, —COOR$^{11}$ (where R$^{11}$ is a C1 to C6 alkyl group or a C1 to C6 hydroxyalkyl group), a urea group (—NH—C(═O)—N(R$^{13}$)$_2$, where R$^{13}$ are each independently a hydrogen atom or a C1 to C6 alkyl group), —COO(CH$_2$)$_2$NHCOOR$^{14}$ (where R$^{14}$ is a C1 to C4 alkyl group); or —COO(CH$_2$)$_2$—NH—C(═O)—N(R$^{15}$)$_2$ (where R$^{15}$ are each independently a hydrogen atom or a C1 to C6 alkyl group);

$R^3$ represent a hydrogen atom or a methyl group:

$R^2$ represents a C1 to C4 alkyl group; and $R^3$ represent a hydrogen atom or a methyl group.

7. The positive-charging toner according to claim 1, wherein the composition contains a third polymerizable monomer that is different from the first polymerizable monomer and from the second polymerizable monomer; and the third polymerizable monomer is at least one selected from the group consisting of styrene, methyl methacrylate and methyl acrylate.

8. The positive-charging toner according to claim 1, wherein the toner contains at least one selected from the group consisting of a positive-charging charge control agent and a positive-charging charge control resin.

9. The positive-charging toner according to claim 1, wherein the polymer A is a vinyl polymer.

10. The positive-charging toner according to claim 1, wherein the macromonomer is at least one selected from the group consisting of (meth)acrylic acid ester polymers containing an acryloyl group or a methacryloyl group at a molecular chain end.

11. The positive-charging toner according to claim 1, wherein the toner contains an external additive, and contains a conductive layer on the surface of the external additive.

12. The positive-charging toner according to claim 11, wherein the conductive layer is a film-forming body containing tin oxide doped with antimony.

* * * * *